US012674618B2

(12) United States Patent
Jeong et al.

(10) Patent No.: US 12,674,618 B2
(45) Date of Patent: Jul. 7, 2026

(54) REFRIGERATOR AND METHOD OF CONTROLLING THE SAME

(71) Applicant: SAMSUNG ELECTRONICS CO., LTD., Suwon-si (KR)

(72) Inventors: Jin Jeong, Suwon-si (KR); Ganghyun Kim, Suwon-si (KR); Hyekyoung An, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 981 days.

(21) Appl. No.: 17/845,401

(22) Filed: Jun. 21, 2022

(65) Prior Publication Data

US 2022/0316792 A1 Oct. 6, 2022

Related U.S. Application Data

(63) Continuation of application No. PCT/KR2020/017770, filed on Dec. 7, 2020.

(30) Foreign Application Priority Data

Dec. 20, 2019 (KR) ..... 10-2019-0172434
Dec. 27, 2019 (KR) ..... 10-2019-0176111
Nov. 20, 2020 (KR) ..... 10-2020-0157109

(51) Int. Cl.
*F25D 31/00* (2006.01)
*F25D 17/06* (2006.01)
(Continued)

(52) U.S. Cl.
CPC ..... *F25D 23/12* (2013.01); *F25D 17/065* (2013.01); *F25D 29/00* (2013.01); *F25D 31/005* (2013.01);
(Continued)

(58) Field of Classification Search
CPC ..... F25D 23/12; F25D 17/065; F25D 29/00; F25D 31/005; F25D 2400/02; F25D 2600/02; F25D 2700/121
See application file for complete search history.

(56) References Cited

U.S. PATENT DOCUMENTS 4,484,515 A * 11/1984 Illy ..... A47J 31/52 222/54
5,228,499 A * 7/1993 Yoon ..... F25D 17/065 165/263
(Continued)

FOREIGN PATENT DOCUMENTS

CN 103344084 A 10/2013
CN 107581254 A 1/2018
(Continued)

OTHER PUBLICATIONS

Office Action dated Jul. 4, 2024 issued in European Application No. 20 904 166.4.
(Continued)

*Primary Examiner* — Tiffany T Tran
(74) *Attorney, Agent, or Firm* — STAAS & HALSEY LLP

(57) ABSTRACT

A refrigerator including a refrigerator compartment, a dairy product maker inside the refrigerator compartment, a control panel configured to receive a control command, and a controller configured to control the dairy product maker based on the control command, the dairy product maker includes a container to store milk or a dairy product, a heater configured to heat the milk stored in the container, a fan configured to supply cool air inside the refrigerator compartment to the container, and a temperature sensor configured to measure a temperature inside of the dairy product maker, and the controller operates the heater for a preset fermentation period in response to the control command,
(Continued)

turns off the heater and turns on the fan to cool down inside of the container after a lapse of the preset fermentation period, and turns off the fan in response to completing of the cooling down inside of the container.

14 Claims, 24 Drawing Sheets

(51) Int. Cl.
*F25D 23/12* (2006.01)
*F25D 29/00* (2006.01)

(52) U.S. Cl.
CPC ..... *F25D 2400/02* (2013.01); *F25D 2600/02* (2013.01); *F25D 2700/121* (2013.01)

(56) References Cited

U.S. PATENT DOCUMENTS

| | | | | |
|---|---|---|---|---|
| 9,648,844 | B2 | 5/2017 | Jeong et al. | |
| 2006/0149441 | A1* | 7/2006 | Takamura | G01K 15/00 701/29.2 |
| 2008/0066485 | A1* | 3/2008 | Park | A23B 7/04 62/441 |
| 2012/0017629 | A1* | 1/2012 | Shin | F25D 23/12 62/389 |
| 2015/0143832 | A1* | 5/2015 | Jeong | A01J 25/12 62/135 |
| 2016/0061506 | A1* | 3/2016 | Song | F25B 39/02 62/216 |
| 2017/0240410 | A1* | 8/2017 | Kim | B67D 1/1477 |
| 2019/0041262 | A1* | 2/2019 | Hasegawa | H04Q 9/00 |

FOREIGN PATENT DOCUMENTS

| | | | | |
|---|---|---|---|---|
| EP | 1151967 | A1 * | 11/2001 | C02F 3/343 |
| JP | 9-51759 | A | 2/1997 | |
| JP | 2009-236345 | A | 10/2009 | |
| KR | 1999-0061276 | A | 7/1999 | |
| KR | 1999-0084757 | A | 12/1999 | |
| KR | 10-0364905 | B1 | 12/2002 | |
| KR | 10-2006-0127664 | A | 12/2006 | |
| KR | 10-0750251 | | 8/2007 | |
| KR | 10-2015-0003495 | A | 1/2015 | |
| KR | 10-2015-0061672 | A | 6/2015 | |
| KR | 20020036109 | A * | 5/2022 | F25D 29/00 |

OTHER PUBLICATIONS

Office Action dated Jun. 14, 2024 issued in Indian Application No. 202217034044.
Office Action dated May 2, 2024 issued in Indian Application No. 202217034044.
Office Action dated Oct. 27, 2022 issue in India Application No. 202217034044.
European Search Report dated Dec. 8, 2022 issued in European Application No. EP 20 90 4166.
Written Opinion of International Searching Authority dated Mar. 29, 2021 in International Application No. PCT/KR2020/017770.
International Search Report dated Mar. 29, 2021 in International Application No. PCT/KR2020/017770.

* cited by examiner

REFRIGERATOR AND METHOD OF CONTROLLING THE SAME

CROSS-REFERENCE TO RELATED APPLICATIONS

This application is a continuation application, filed under 35 U.S.C. § 111(a), of International Application PCT/KR2020/017770 filed Dec. 7, 2020, and is based on and claims priority under 35 U.S.C. § 119 to Korean Patent Applications No. 10-2019-0172434, filed on Dec. 20, 2019, No. 10-2019-0176111, filed on Dec. 27, 2019, and No. 10-2020-0157109, filed on Nov. 20, 2020, in the Korean Intellectual Property Office. The disclosures of International Application PCT/KR2020/017770, and Korean Patent Applications No. 10-2019-0172434, No. 10-2019-0176111, and No. 10-2020-0157109, the disclosure of which is are incorporated by reference herein in its their entireties.

BACKGROUND

1. Field

The present disclosure relates to a refrigerator including a dairy product maker inside in a refrigerator compartment and a method of controlling the same.

2. Description of the Related Art

A refrigerator, which generally includes a storage compartment and a cool air supply device to supply cool air to the storage compartment, is an apparatus used to keep food fresh. The storage compartment is maintained within a certain temperature range required to keep food fresh.

A dairy product maker is an apparatus for producing a dairy product such as yogurt and cheese by fermenting milk. By heating a container that contains milk, milk is fermented to produce a fermented dairy product. Because a dairy product maker is independently provided and only has a function to produce dairy products by fermenting milk, there is an inconvenience of moving the dairy product produced by the dairy product maker into a separate refrigerator for storage.

Therefore, there have recently been made attempts to install a dairy product maker in a refrigerator compartment to produce a dairy product using the dairy product maker and keep the produced dairy product refrigerated using cool air of the refrigerator compartment, thereby removing user's inconvenience.

SUMMARY

Provided are a refrigerator and a control method therefor. The refrigerator easily controls the operation of a dairy product maker via a control panel by a user, easily recognizes the operation state of the dairy product maker, and controls the dairy product maker to produce a dairy product even when an error occurs in a component constituting the dairy product maker, thereby providing the dairy product regardless of occurrence of the error.

In accordance with an aspect of the present disclosure, a refrigerator includes a refrigerator compartment to produce a dairy product, a dairy product maker provided inside the refrigerator compartment, a control panel configured to receive a control command for the dairy product maker from a user and display a state of the dairy product maker, and a controller configured to control the dairy product maker based on the received control command, wherein the dairy product maker includes a container to store milk for producing the dairy product or the produced dairy product, a heater configured to heat the milk stored in the container, a fan configured to supply cool air inside the refrigerator compartment to the container, and a temperature sensor configured to measure a temperature inside of the dairy product maker, and the controller operates the heater for a preset fermentation period in response to the receiving control command, turns off the heater and turns on the fan to cool down the temperature inside of the container after a lapse of the preset fermentation period, and turns off the fan in response to completing of the cooling down inside of the container.

The control command includes a control command for a first fermentation mode and a control command for a second fermentation mode, and a fermentation period corresponding to the first fermentation mode may be shorter than a fermentation period corresponding to the second fermentation mode.

The controller may operate the heater for the fermentation period corresponding to the first fermentation mode in response to receiving the control command for the first fermentation mode, and extend an operation period of the heater to operate the heater for the fermentation period corresponding to the second fermentation mode in response to receiving the control command for the second fermentation mode while the first fermentation mode is in progress.

The controller may operate the heater for the fermentation period corresponding to the second fermentation mode upon receiving the control command for the second fermentation mode, and compare a fermentation period progressed according to the second fermentation mode with the fermentation period corresponding to the first fermentation mode upon receiving the control command for the first fermentation mode while the second fermentation mode is in progress.

The controller may operate the heater during the fermentation period corresponding to the first fermentation mode in the case where the fermentation period progressed according to the second fermentation mode is shorter than the fermentation period corresponding to the first fermentation mode, and turn off the heater in the case where the fermentation period progressed according to the second fermentation mode is longer than the fermentation period corresponding to the first fermentation mode.

The controller may turn off the heater and turn on the fan upon receiving a control command for a cooling mode while the heater operates, and turn off the fan and turn on the heater upon receiving a control command for the first fermentation mode or a control command for the second fermentation mode while the fan operates.

The controller may cool down the container to a preset cooling temperature by repeatedly turning off the heater and turning on the fan after a lapse of the preset fermentation period, and further cools down the container to a preset refrigeration temperature by controlling the fan upon completing of the cooling of the container, and the refrigeration temperature may be lower than the cooling temperature.

The controller may count the progression of the preset fermentation period in the case where the temperature of the dairy product maker is higher than the preset fermentation start temperature, and turn on the heater to increase the temperature of the dairy product maker to the fermentation start temperature in the case where the temperature of the dairy product maker is below the preset fermentation start temperature, and counts the progression of the preset fermentation period from a time point at which the temperature of the dairy product maker reaches the fermentation start temperature.

The controller may determine whether an error occurs in the temperature sensor upon receiving the control command for the dairy product maker, turns off the heater after a lapse of a preset first period from a time point at which the heater is turned on upon determining that there is an error in the temperature sensor, and operate the fan for a preset second period after the heater is turned off.

The controller may control the control panel to display an error state upon determination that an error occurs in at least one of the heater, the wind-blowing fan, and the temperature sensor.

The controller may control the control panel to display a production completion state after a lapse of a preset third period after the heater is turned off.

The preset third period may be shorter than the preset second period.

The controller may determine an error of the temperature sensor when the controller receives an output of the temperature sensor is 0V or an input voltage of the temperature sensor is 0V.

The controller may determine an error of the temperature sensor when the temperature sensor outputs a temperature below a preset first reference temperature for a preset reference period or longer.

The controller may determine an error of the temperature sensor when the temperature sensor outputs a temperature above a preset second reference temperature for a preset reference period or longer.

According to an embodiment, a refrigerator comprises a refrigerator compartment, a dairy product maker provided inside the refrigerator compartment and to produce a dairy product. The dairy product maker comprising a container to store milk to produce the dairy product or the produced dairy product, a heater configured to heat the milk stored in the container, a fan configured to supply cool air inside the refrigerator compartment to the container, and a temperature sensor configured to measure a temperature inside of the dairy product maker.

The refrigerator further comprises at least one memory storing instructions, and at least one processor which executes the stored instructions to cause the following to be performed: receive a control command to operate the dairy product; turning on the heater in response to receiving the control command to produce the dairy product in a first period; turns off the heater and turns on the fan to cool down the temperature inside of the container in a second period; repeatedly turns on and off the fan after the second period elapses in a third period; determining whether there is an error of the temperature sensor in the third period; turn off the fan to complete the cooling down in response to the determining that there is no error and the temperature inside of the dairy product maker reaches the a preset temperature; and determining whether the third period is elapsed in response to the determining that there is an error of the temperature sensor; and turns off the fan in response to the determining that third period is elapsed.

According to the refrigerator and the control method therefor according to an embodiment, the user may easily control the operation of the dairy product maker via the control panel, easily recognize the operation state of the dairy product maker, and control the dairy product maker to produce a dairy product even when an error occurs in a component constituting the dairy product maker, and thus the dairy product may be provided regardless of occurrence of the error.

DETAILED DESCRIPTION

Figure 1:
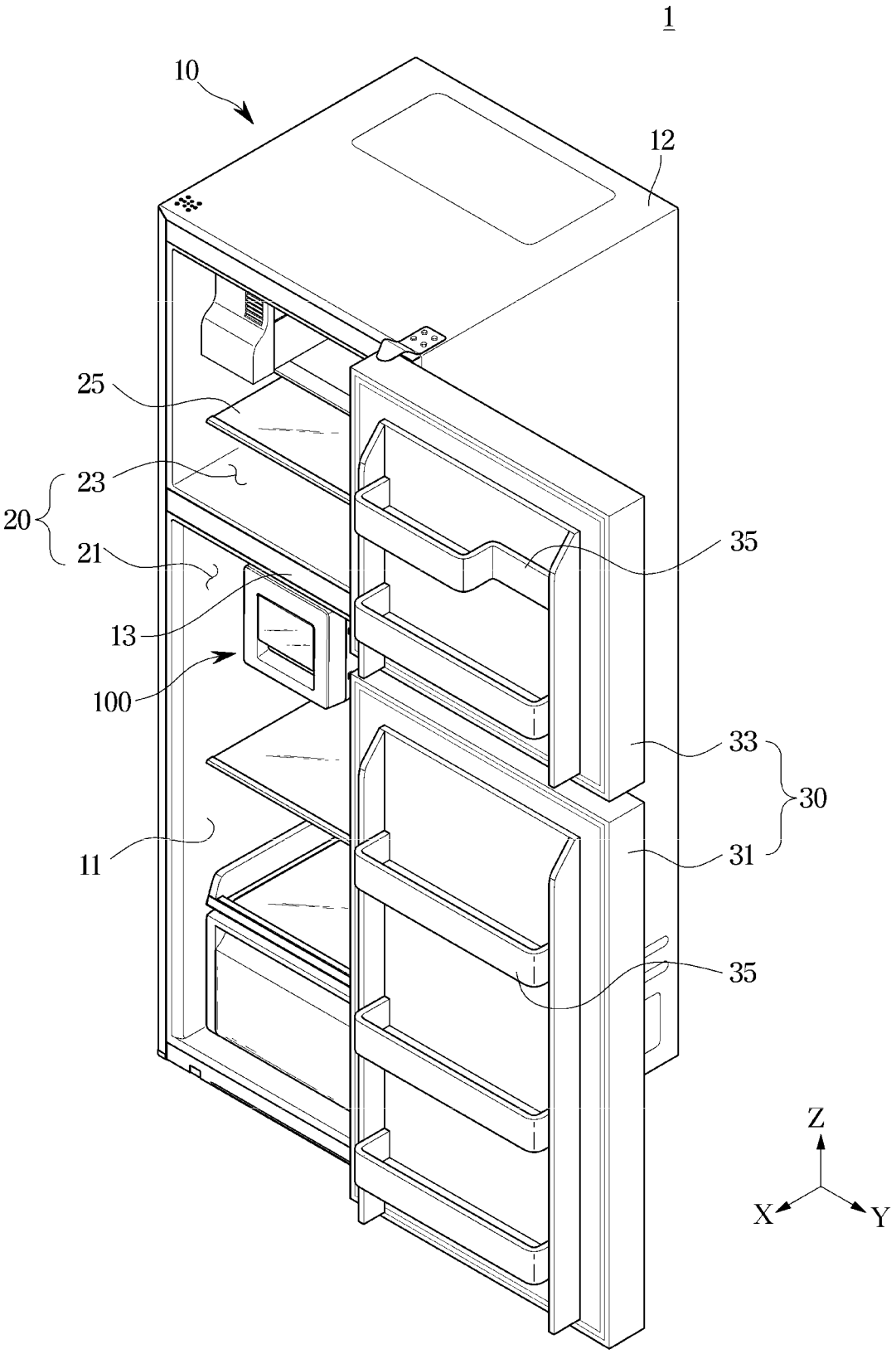
FIG. 1 is a perspective view of a refrigerator including a dairy product maker provided inside a refrigerator compartment according to an embodiment of the present disclosure.

Reference will now be made in detail to the embodiments of the present disclosure, examples of which are illustrated in the accompanying drawings. The embodiments described in the specification and shown in the drawings are only illustrative and are not intended to represent all aspects of the invention, such that various modifications may be made without departing from the spirit of the invention.

Throughout the specification, when an element is referred to as being "connected to" another element, it may be directly or indirectly connected to the other element and the "indirectly connected to" includes connected to the other element via a wireless communication network.

In addition, the terms used in the present specification are merely used to describe particular embodiments, and are not intended to limit the present disclosure. An expression used in the singular encompasses the expression of the plural, unless it has a clearly different meaning in the context. In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It will be understood that, although the terms "first", "second", etc., may be used herein to describe various elements, these elements should not be limited by these terms. The above terms are used only to distinguish one component from another. For example, a first component discussed below could be termed a second component, and similarly, the second component may be termed the first component without departing from the teachings of this disclosure.

In addition, the terms "unit", "device", "block", "member", and "module" used herein refer to a unit used to process at least one function or operation. For example, these terms may refer to one or more hardware components such as field-programmable gate array (FPGA) or application specific integrated circuit (ASIC), one or more software components stored in a memory, or one or more processors.

The reference numerals used in operations are used for descriptive convenience and are not intended to describe the order of operations and the operations may be performed in a different order unless the order of operations are clearly stated.

Hereinafter, embodiments of the present disclosure will be described in detail with reference to the accompanying drawings.

Figure 2:
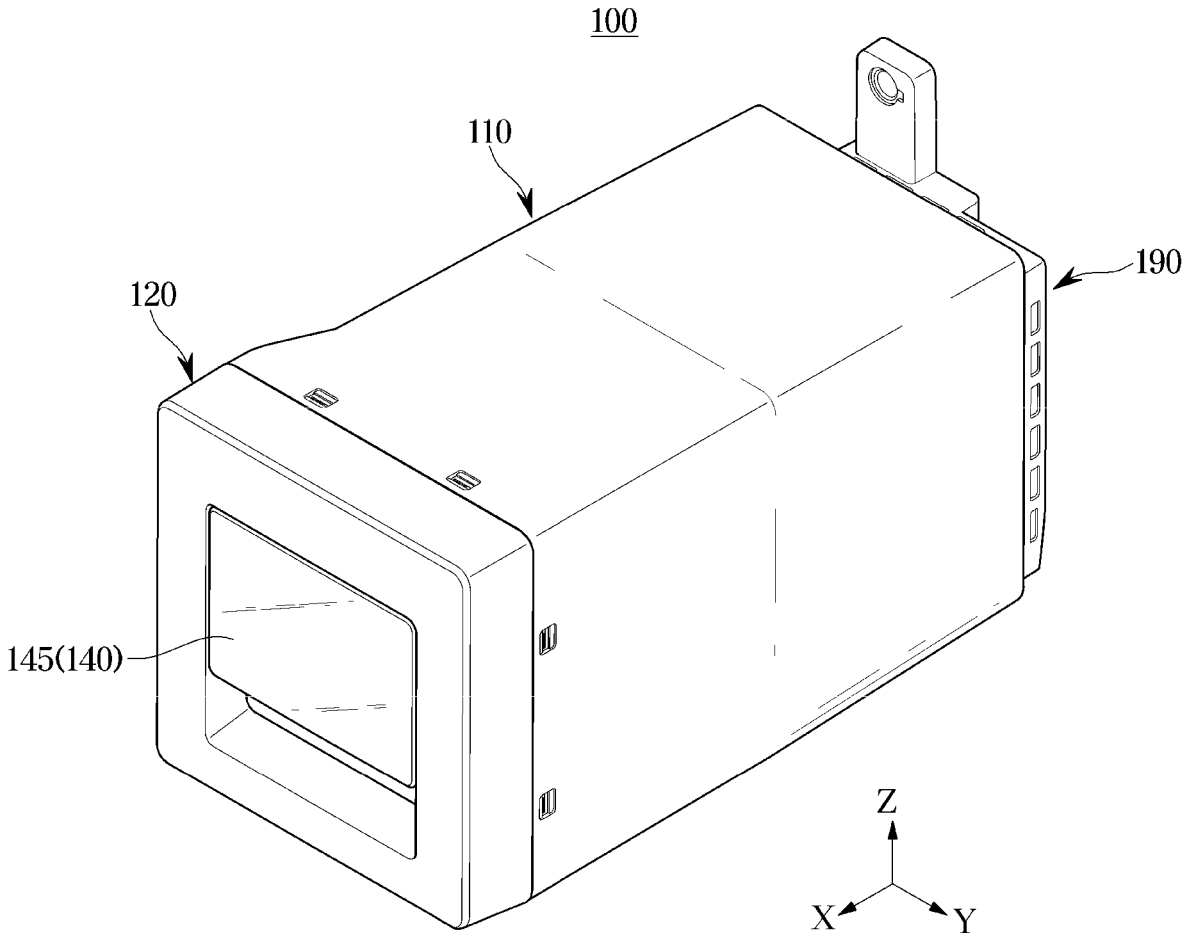
FIG. 2 is a perspective view of a dairy product maker according to an embodiment of the present disclosure.
Figure 3:
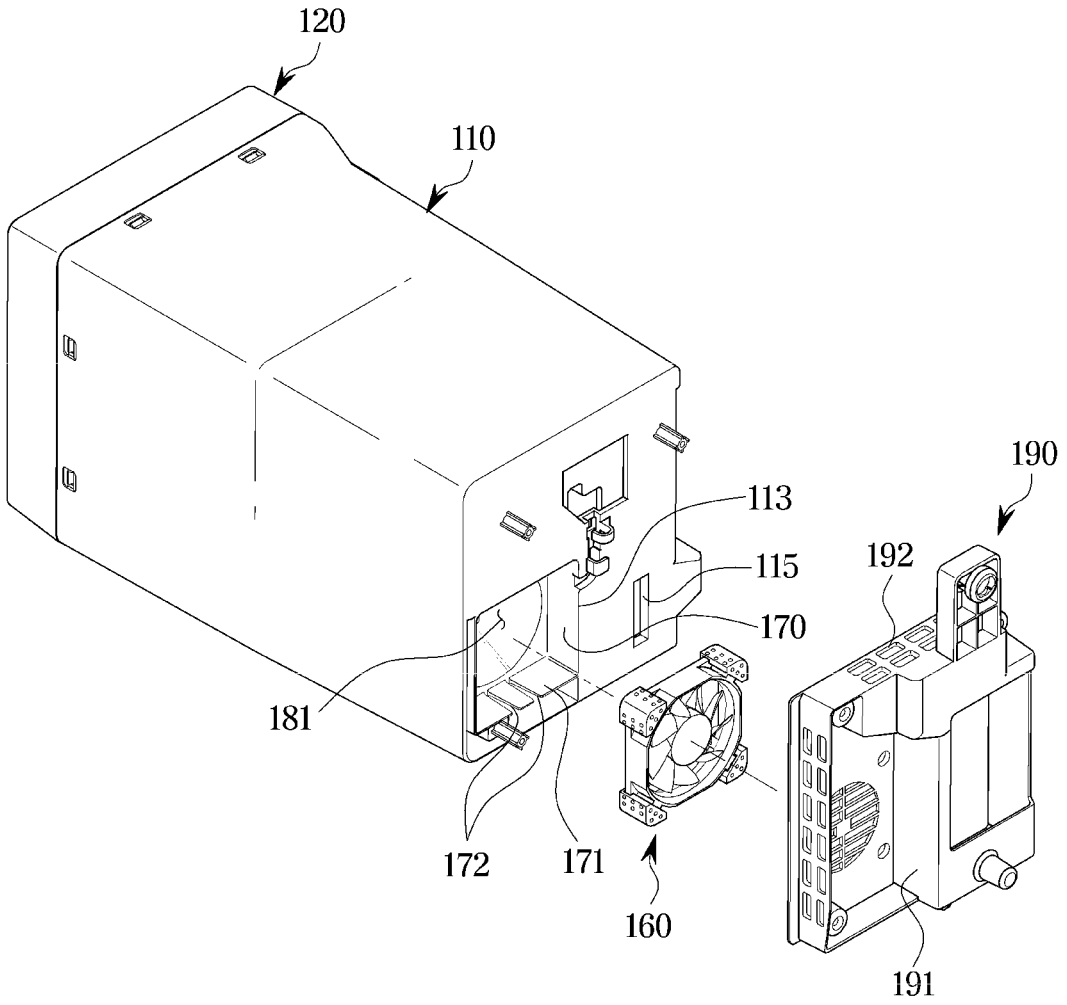
FIG. 3 is an exploded view of a rear side of a dairy product maker according to an embodiment of the present disclosure.
Figure 4:
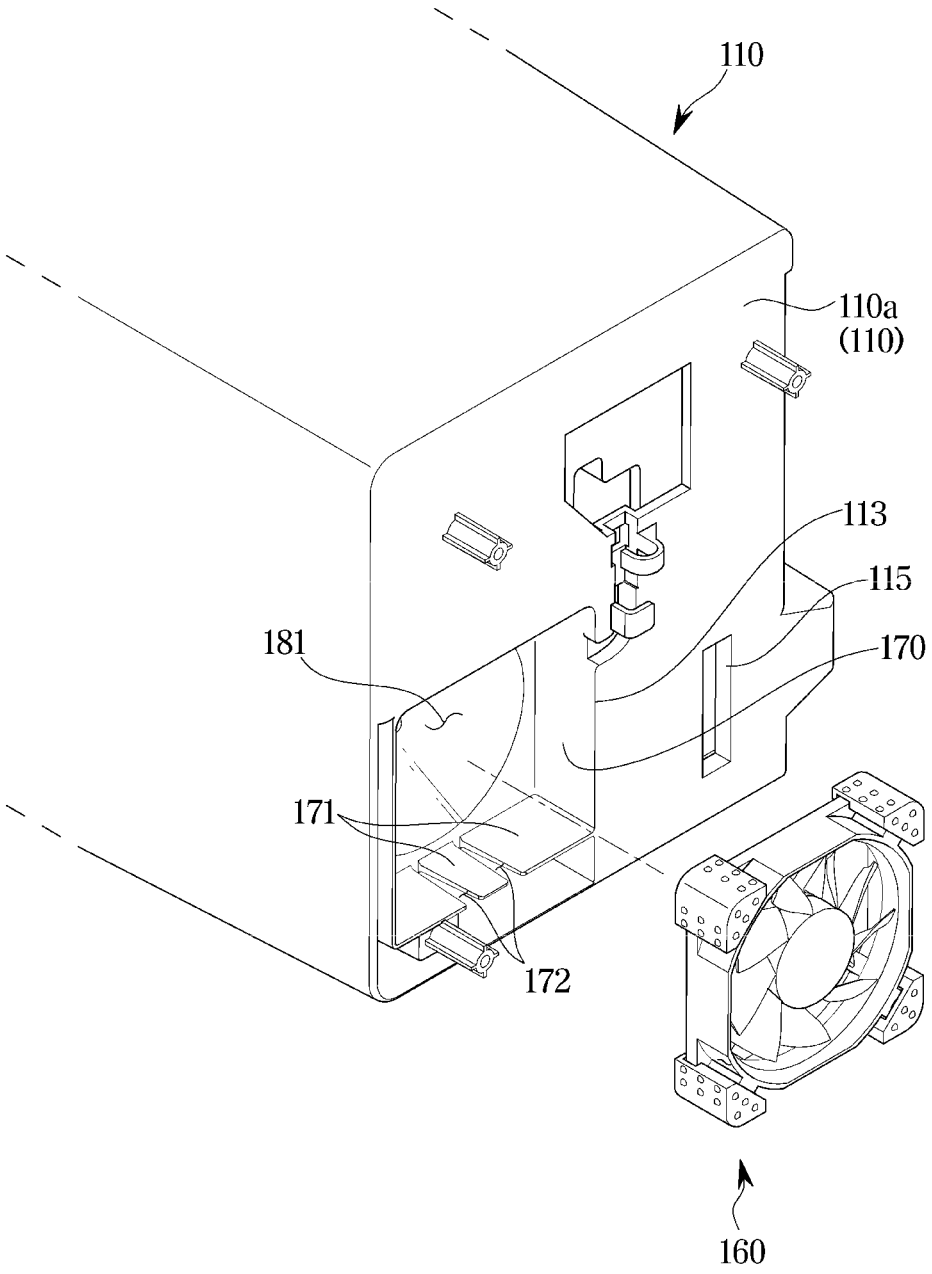
FIG. 4 is an enlarged view of a wind-blowing fan mount and a wind-blowing fan shown in FIG. 3.
Figure 5:
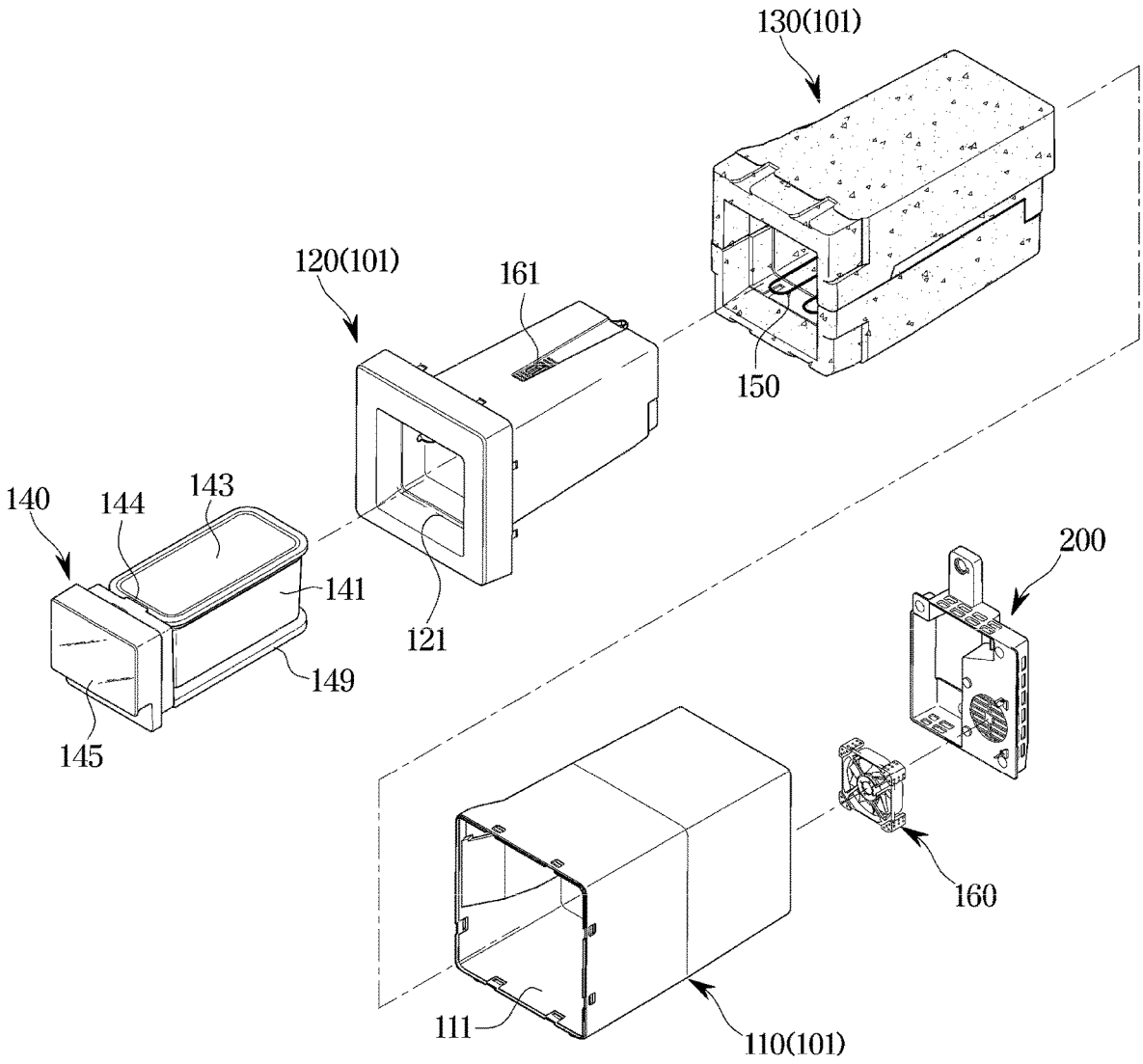
FIG. 5 is an exploded view of a dairy product maker according to an embodiment of the present disclosure.
Figure 6:
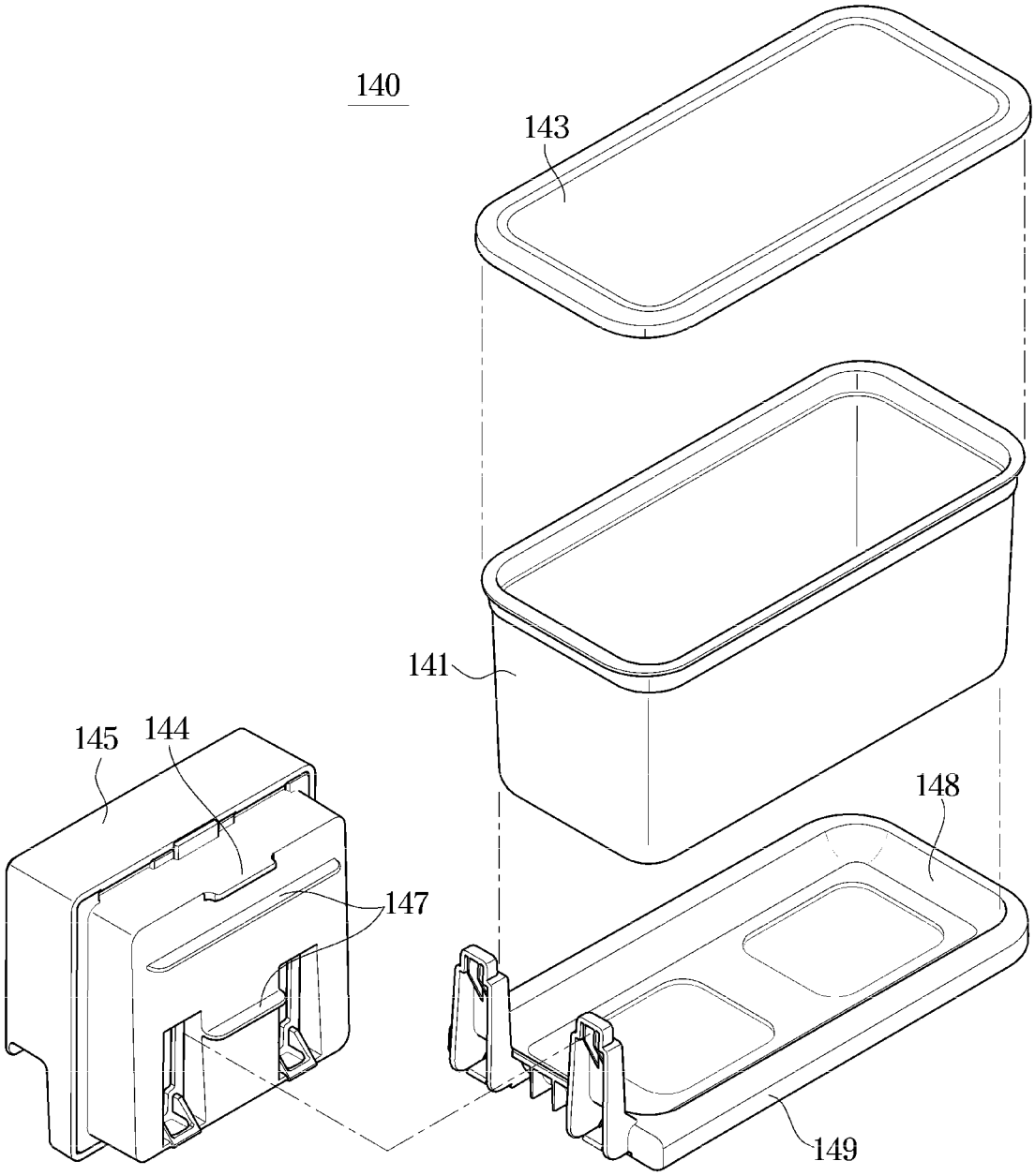
FIG. 6 is an exploded perspective view of a dairy product container assembly of a dairy product maker according to an embodiment of the present disclosure.
Figure 7:
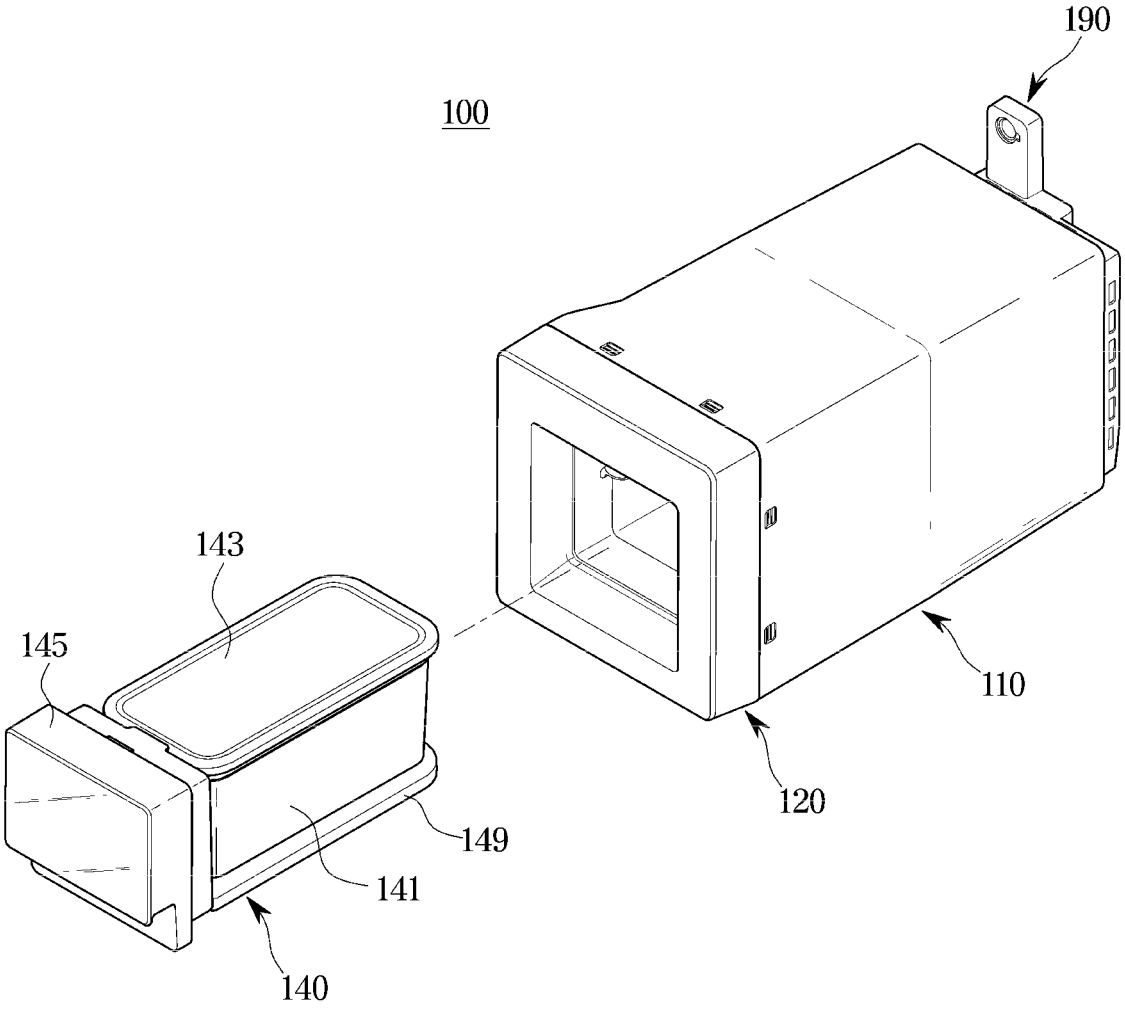
FIG. 7 is a view illustrating a dairy product container assembly withdrawn from a dairy product maker according to an embodiment of the present disclosure.

FIG. 1 is a perspective view of a refrigerator including a dairy product maker provided inside a refrigerator compartment according to an embodiment of the present disclosure. FIG. 2 is a perspective view of a dairy product maker according to an embodiment of the present disclosure. FIG. 3 is an exploded rear view of a dairy product maker according to an embodiment of the present disclosure. FIG. 4 is an enlarged view of a wind-blowing fan mount and a wind-blowing fan shown in FIG. 3. FIG. 5 is an exploded view of a dairy product maker according to an embodiment of the present disclosure. FIG. 6 is an exploded perspective view of a dairy product container assembly of a dairy product maker according to an embodiment of the present disclosure. FIG. 7 is a view illustrating a dairy product container assembly withdrawn from a dairy product maker according to an embodiment of the present disclosure.

Referring to FIG. 1, a refrigerator 1 includes a main body 10, a storage compartment 20 provided inside the main body 10 and having an open front, and a door 30 pivotally coupled to the main body 10 to open and close the front of the storage compartment 20.

The main body 10 includes an inner cabinet 11 defining the storage compartment 20, an outer cabinet (not shown) defining the external appearance, and a cool air supply device (not shown) configured to supply cool air to the storage compartment 20.

The cool air supply device may include a compressor, a condenser, an expansion valve, an evaporator, a fan, and a cool air duct, and an insulator (not shown) is disposed between the inner cabinet 11 and the outer cabinet of the main body 10 to prevent leakage of cool air from the storage compartment 20.

The storage compartment 20 may be partitioned into a refrigerator compartment 21 and a freezer compartment 23 by a partition wall 13, and a plurality of shelves 25 provided therein may partition the refrigerator compartment 21 and the freezer compartment 23 into a plurality of sections, respectively.

The refrigerator compartment 21 and the freezer compartment 23 may be open or closed by a refrigerator compartment door 31 and a freezer door 33 respectively pivotally coupled to the main body 10, and a plurality of door guards 35 may be mounted on the rear surface of the door 30 to accommodate foods.

A dairy product maker 100 configured to make dairy products such as curd, labneh, skyr, kefir, yogurt, and cheese by fermenting milk may be provided inside the refrigerator compartment 21.

Although the dairy product maker 100 is located inside the refrigerator compartment 21 in the drawings, the dairy product maker 100 may also be accommodated in a separate space independently provided in the refrigerator compartment 21.

Referring to FIGS. 2 to 5, the dairy product maker 100 may include a case 101 including an outer case 110 defining the external appearance, an inner case 120 provided inside the outer case 110, and an insulator 130 disposed between the outer case 110 and the inner case 120.

The dairy product maker 100 may include a dairy product container assembly 140 including a dairy product container 141 that stores milk and is accommodated in the inner case 120.

The dairy product maker 100 may include a heater 150 configured to heat the dairy product container 141 to ferment milk stored in the dairy product container 141 and a wind-blowing fan 160 configured to supply cool air to the dairy product container 141 to keep the fermented milk refrigerated.

The dairy product maker 100 may include a temperature sensor 161 configured to measure a temperature therein.

The front of the outer case 110 may have an opening 111 to allow the insulator 130 and the inner case 120 to be inserted into the outer case 110. The front of the inner case 120 may have an opening 121 allowing the dairy product container 141 to be inserted into and withdrawn from the inner case 120.

A partition 190 configured to separate the inner cabinet 11 from the dairy product maker 100 may be coupled to the rear surface of the outer case 110.

The partition 190 may have a plurality of vents 192 such that cool air inside the refrigerator compartment 21 is sucked through a suction port 113 formed in the case 101 of the dairy product maker 100 and the sucked cool air is discharged back into the refrigerator compartment 21 through a discharge port 115 formed in the case 101 of the dairy product maker 100.

The partition 190 may be provided with a blocking partition wall 191 to prevent the cool air discharged through the discharge port 115 from being sucked back into the suction port 113 and recirculated.

A rear wall 110*a* of the outer case 110 may be provided with a wind-blowing fan mount 170 having an inflow channel 181 formed therein to suck cool air inside the refrigerator compartment 21, and the wind-blowing fan 160 may be mounted on the wind-blowing fan mount 170.

Specifically, the wind-blowing fan 160 may be mounted in the inflow channel 181 formed in the wind-blowing fan mount 170. A discharge port 115 through which cool air sucked into the dairy product maker 100 is discharged may be provided on the rear surface of the outer case 110.

A first suction port 113 may be formed at one end of the wind-blowing fan mount 170 and the wind-blowing fan 160 may be mounted on the wind-blowing fan mount 170 to communicate with the first suction port 113 through one side thereof. One end of the inflow channel 181 may communicate with the first suction port 113.

The wind-blowing fan 160 may be inserted into the wind-blowing fan mount 170 to be mounted thereon, the wind-blowing fan mount 170 recessed as a part of the rear wall 110*a* of the outer case 110.

The wind-blowing fan mount 170 may include a wind-blowing fan lower mount wall 171 constituting the lower surface of the wind-blowing fan mount 170. The wind-blowing fan lower mount wall 171 may protrude from the rear surface of the outer case 110 and constitute a part of the first suction port 113. Specifically, the wind-blowing fan lower mount wall 171 may be provided at a lower end of the outer surface of the rear wall 110*a* in the form of a plate-shaped rib extending in the horizontal direction.

One end of the wind-blowing fan lower mount wall 171 may correspond to a part of the first suction port 113. The wind-blowing fan lower mount wall 171 constituting the lower surface of the wind-blowing fan mount 170 may support the wind-blowing fan 160 under the wind-blowing fan 160.

The wind-blowing fan lower mount wall 171 may be provided with a drain slit 172. Specifically, the wind-blowing fan lower mount wall 171 may extend in the horizontal direction and the drain slit 172 may be formed to penetrate the wind-blowing fan lower mount wall 171. In other words, with respect to the wind-blowing fan lower mount wall 171, a space above the wind-blowing fan lower mount wall 171 may be connected to a space below the wind-blowing fan lower mount wall 171 via the drain slit 172. Therefore, milk and/or a dairy product on the upper surface of the wind-blowing fan lower mount wall 171 may be drained into the space below the wind-blowing fan lower mount wall 171 through the drain slit 172.

The space below the wind-blowing fan lower mount wall 171 may be connected to the outside of the dairy product maker 100. Milk or the dairy product flowing over the dairy product container 141 onto the upper surface of the wind-blowing fan mount 170 through the inflow channel 181 may be drained out of the dairy product maker 100 through the drain slit 172 by gravity or fine vibration of the wind-blowing fan 160. Therefore, contamination of the wind-blowing fan 160 by the milk or the dairy product flowing over the dairy product container 141 may be prevented and malfunction of the dairy product maker 100 caused by the contamination may be prevented.

The dairy product maker 100 may include the inner case 120 in which an accommodation space to accommodate the dairy product container 141 is formed. The accommodation space may be formed by left, right, top, bottom, and rear surfaces of the inner case 120 and the front of the accommodation space may correspond to the opening 121.

The inner case 120 may be integrally formed by injection molding. In this case, there is no gap between surfaces of the inner case 120 which may be formed when the surfaces are separately manufactured and assembled or the inner case 120 is manufactured in two pieces and assembled, and thus milk or a dairy product flowing over the dairy product container 141 into an accommodation space does not enter such a gap and may be easily removed.

Referring to FIGS. 6 and 7, the dairy product container assembly 140 may include the dairy product container 141 configured to store milk and inserted into the accommodation space of the inner case 120, a lid 143 to cover the top of the open dairy product container 141, a dairy product door 145 for opening and closing the opening 121 provided at the front of the inner case 120, and a mounting bracket 149 coupled to the dairy product door 145 and detachably mounted with the dairy product container 141.

The dairy product door 145 may include a partition rib 147 provided at the rear surface of the dairy product door 145. The partition rib 147 may partition the cooling flow channel 180 into upper and lower channels together with partition ribs (not shown) provided on the left and right surfaces of the inner case 120 to form a first flow channel and a second flow channel.

The dairy product door 145 may include a separation-preventing protrusion 144 to prevent the dairy product container 141 from being separated from the mounting bracket 149 by an impact applied when the dairy product container assembly 140 is inserted into or withdrawn from the accommodation space. The separation-preventing protrusion 144 may protrude from the rear surface of the dairy product door 145.

The dairy product container 141 has an open top, stores milk to produce a dairy product, and is inserted into the dairy product maker 100. To prevent a produced dairy product from flowing over the dairy product container 141, the lid 143 is provided on the open top of the dairy product container 141 to seal the dairy product container 141.

Milk stored in the dairy product container 141 may be heated by the heater 150 to be fermented to produce a dairy product. Overfermentation of the produced dairy product may be prevented by cooling of the wind-blowing fan 160 and the dairy product may be kept refrigerated in a fresh state.

The dairy product door 145 slides to open or close the opening 121 of the inner case 120 and the dairy product container 141 is detachably mounted on the mounting bracket 149 coupled to the dairy product door 145, and thus the dairy product container 141 is inserted or withdrawn in accordance with opening and closing of the dairy product door 145.

The mounting bracket 149 may include a holder 148 formed to surround the bottom surface of the dairy product container 141 and lower edges of the dairy product container 141. Specifically, the lower edges may be rounded to have a curved surface and the holder 148 of the mounting bracket 149 may have a curved surface corresponding to the curved surface of the lower edges of the dairy product container 141. When the dairy product container 141 is mounted on the mounting bracket 149, the holder 148 may surround the edges of the dairy product container 141 and prevent the dairy product container 141 from being separated from the mounting bracket 149.

The dairy product container 141 may be detachably coupled to the mounting bracket 149 in a state being covered with the lid 143. Specifically, the dairy product container 141 may be mounted in a space between the mounting bracket 149 and the separation-preventing protrusion 144. Alternatively, the lower edges of the dairy product container 141 may be supported by the holder 148 and the upper end of the dairy product container 141 may be supported by the separation-preventing protrusion 144. Therefore, when the dairy product container 141 is inserted into or withdrawn from the inner case 120 in a state being mounted in the dairy product container assembly 140, separation of the dairy product container 141 from the mounting bracket 149 may be prevented even when an impact is applied thereto.

The structures of the refrigerator 1 and the dairy product maker 100 provided in the refrigerator 1 are described in detail above. Hereinafter, the operation of the refrigerator 1 and the dairy product maker 100 will be described in detail.

Figure 8:
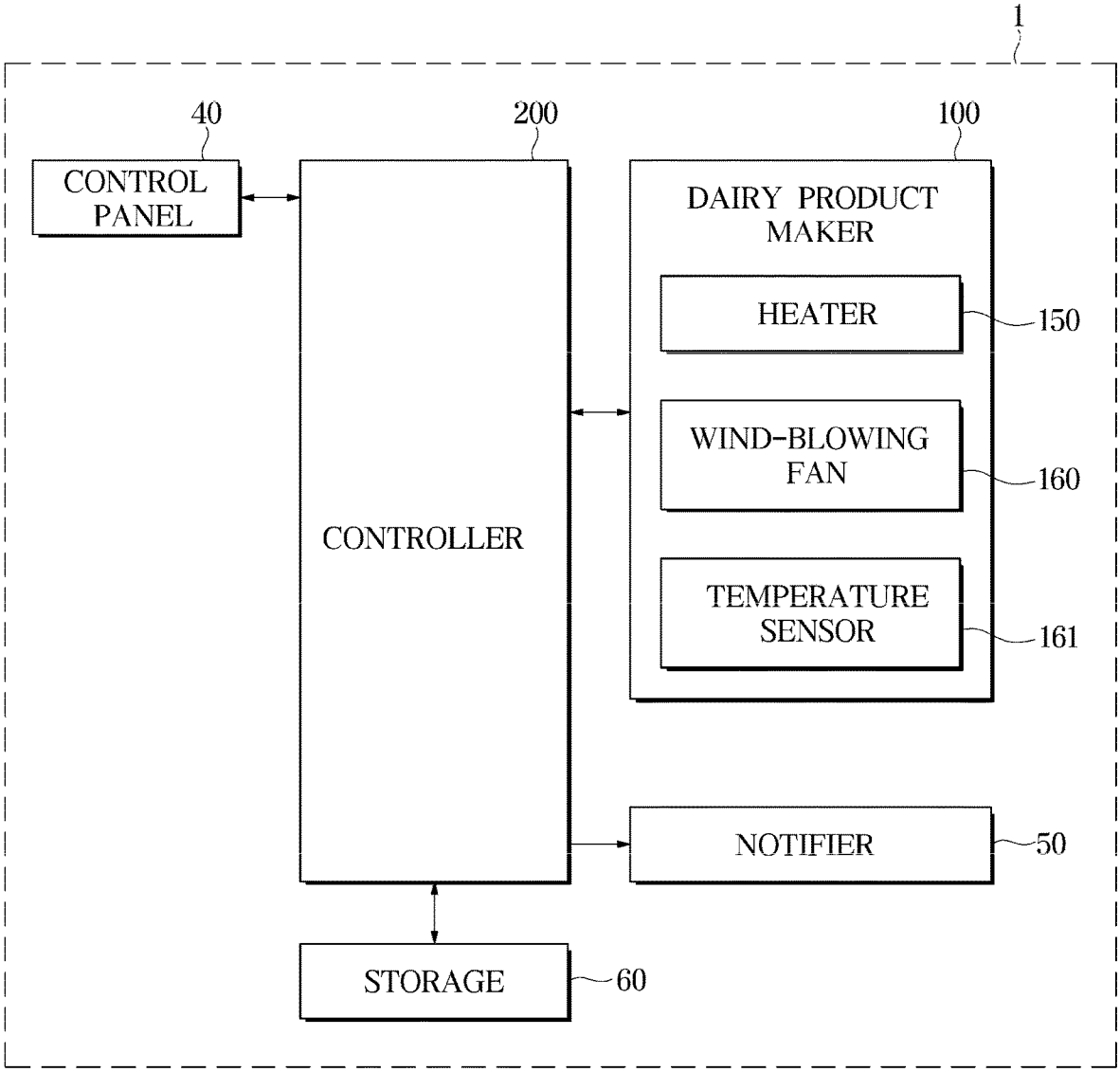
FIG. 8 is a control block diagram of a refrigerator according to an embodiment of the present disclosure.
Figure 9:
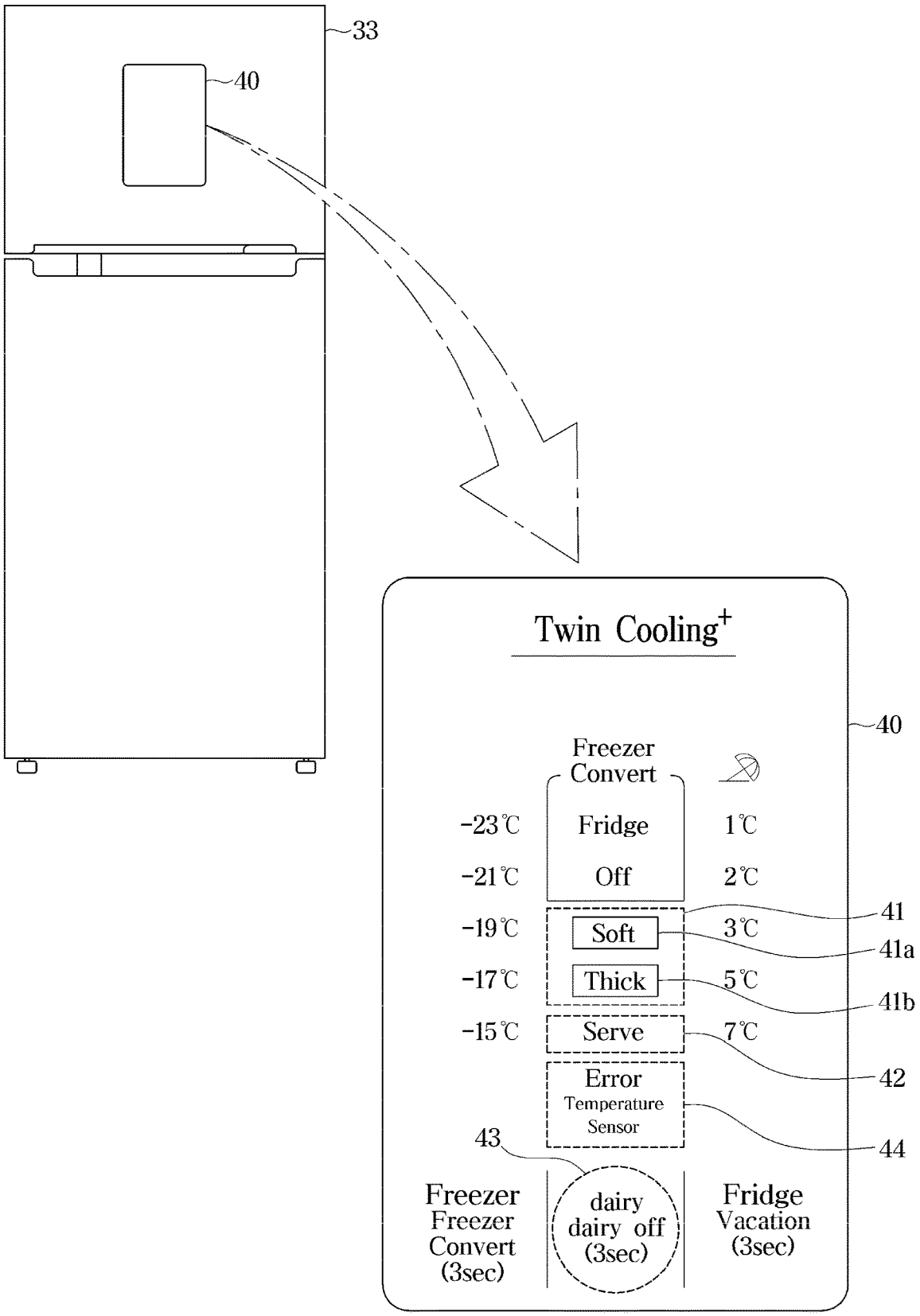
FIG. 9 is a view illustrating a control panel of a refrigerator according to an embodiment of the present disclosure.

FIG. 8 is a control block diagram of the refrigerator 1 according to an embodiment of the present disclosure. FIG. 9 is a view illustrating a control panel 40 of the refrigerator 1 according to an embodiment of the present disclosure.

Referring to FIGS. 8 and 9, the refrigerator 1 according to an embodiment may include a control panel 40 configured to receive a control command for the dairy product maker 100 from a user and display a state of the dairy product maker 100, a notifier 50 configured to output a notification regarding the operation of the refrigerator 1 and the dairy product maker 100, a storage 60 configured to store data related to the operation and control of the refrigerator 1 and the dairy product maker 100, a dairy product maker 100 configured to produce dairy products by fermenting milk, and a controller 200 configured to perform the control related to the operation of the refrigerator 1 and the dairy product maker 100.

The control panel 40 according to an embodiment may be provided at a freezer door 33 as shown in FIG. 9 and receive, from a user, an input of a control command related to the general operation of the refrigerator 1 or a control command related to the operation of the dairy product maker 100.

A position where the control panel 40 is installed is not limited to the freezer door 33, and the control panel 40 may also be provided at the refrigerator compartment door 31 and at any position inside or outside the refrigerator 1. Meanwhile, the control panel 40 may be provided at the dairy product maker 100 and receive a control command for the dairy product maker 100.

The control panel 40 may include a physical inputter and a display and display operation information and various information of the refrigerator 1. Hereinafter, the control panel 40 implemented as a touch screen will be described for convenience of description.

As shown in FIG. 9, information related to the operation of the refrigerator 1 may be displayed on the control panel 40 in the form of icons. That is, information on temperature of the refrigerator compartment 21 and the freezer compartment 23 of the refrigerator 1 and information related to the control of temperature may be displayed. In addition, information related to the operation and control of the refrigerator 1 may be transmitted to the user by turning on a lamp such as an LED at each of the icons provided on the control panel 40.

Status information related to the operation of the dairy product maker 100 may be displayed on the control panel 40 in the form of icons. A fermentation mode icon 41 to ferment milk by the dairy product maker 100 may be displayed on the control panel 40, and the fermentation mode icon 41 may include a first fermentation mode icon 41*a* and a second fermentation mode icon 41*b*.

The first fermentation mode is a fermentation mode in which a soft dairy product having a lower viscosity is produced due to a relatively short fermentation period, and the second fermentation mode is a fermentation mode in which a thick dairy product having a higher viscosity is produced due to a relatively long fermentation period. That is, the method of controlling the refrigerator 1 according to an embodiment will be described on the assumption that a driving period (fermentation period) of the heater 150 corresponding to the first fermentation mode is shorter than a driving period (fermentation period) of the heater 150 corresponding to the second fermentation mode.

Meanwhile, the fermentation mode of the dairy product maker 100 may further include another fermentation mode in addition to the first fermentation mode and the second fermentation mode. That is, the number and types of the fermentation mode of the dairy product maker 100 may vary according to settings thereof without limitation, and another fermentation icon in addition to the first fermentation mode icon 41*a* and the second fermentation mode icon 41*b* may also be displayed as the fermentation mode icon 41 displayed on the control panel 40. That is, although only two fermentation modes are illustrated in FIG. 9, the number of the fermentation modes is not limited thereto, and the refrigerator 1 may provide a plurality of fermentation modes according to an embodiment via icons respectively corresponding to the plurality of fermentation modes on the control panel 40. Hereinafter, a case, in which the fermentation mode includes a first fermentation mode and a second fermentation mode will be described by way of example.

In the case where a control command for the first fermentation mode is input by the user and the dairy product maker 100 operates in the first fermentation mode, the first fermentation mode icon 41*a* may be displayed on the control panel 40. In the case where a control command for the second fermentation mode is input by the user and the dairy product maker 100 operates in the second fermentation mode, the second fermentation mode icon 41*b* may be displayed on the control panel 40.

As described above, the control panel 40 may receive the input for the fermentation mode of the dairy product maker 100 from the user, and the controller 200, which will be described below, may control the heater 150 to operate for the driving period (fermentation period) corresponding to the fermentation mode input via the control panel 40. In this case, the storage 60 may store preset driving periods (fermentation periods) by fermentation mode.

The control panel 40 may display a dairy product production completion 42 indicating that production of the dairy product has been completed after the dairy product maker 100 fermented milk and cooled the fermented milk.

Also, a fermentation mode select icon 43 to receive an input of a user to select a fermentation mode for producing a dairy product may be displayed on the control panel 40. The user may input a control command for the first fermentation mode or a control command for the second fermentation mode by touching the fermentation mode select icon 43. Meanwhile, the first fermentation mode icon 41*a* and the second fermentation mode icon 41*b* may be alternately displayed on the control panel 40 whenever the user touches the fermentation mode select icon 43, and the dairy product maker 100 may operate in the displayed fermentation mode. That is, the user may input the control command to initiate production of a dairy product by inputting the control command for the fermentation mode via the control panel 40.

In addition, the power of the dairy product maker 100 may be turned off by touching the fermentation mode select icon 43 for a preset period.

Also, the control panel 40 may display an error state icon 44 when an error occurs in a component (e.g., heater 150, wind-blowing fan 160, and temperature sensor 161) constituting the dairy product maker 100.

For example, as shown in FIG. 9, when an error occurs in the temperature sensor 161, the control panel 40 may display the error state icon 44 indicating that an error has occurred in the temperature sensor 161. That is, the error state icon 44 may provide information on a component where an error has occurred and may display a code corresponding to the component as well as directly displaying the component where the error has occurred.

The notifier 50 according to an embodiment may be implemented as a speaker that outputs voice signals or sound signals and may output a notification indicating that production of the dairy product has been completed in the dairy product maker 100.

The storage 60 according to an embodiment may store control programs or control data to control the refrigerator 1 or store control commands input from the user. The storage 60 may store data related to the fermentation mode of the dairy product maker 100 such as driving period of the heater 150, driving period of the wind-blowing fan 160, fermentation temperature, and cooling temperature.

The storage 60 may include a volatile memory (not shown) such as static random-access memory (S-RAM) and dynamic random-access memory (D-RAM) and a non-volatile memory such as flash memory, read only memory (ROM), erasable programmable read only memory (EPROM), and electrically erasable programmable read only memory (EEPROM).

The dairy product maker 100 according to an embodiment may include, as described above, the heater 150 configured to heat the dairy product container 141, the wind-blowing fan 160 configured to supply cool air inside the refrigerator compartment 21 to the dairy product container 141, and the temperature sensor 161 configured to measure a temperature inside the dairy product maker 100.

In the case where a control command to initiate production of a dairy product, i.e., an input to select the fermentation mode for production of a dairy product, is received via the control panel 40, the heater 150 according to an embodiment may be turned on and heat the dairy product container 141 for a driving period (fermentation period) corresponding to the fermentation mode under the control of the controller 200, thereby fermenting milk contained in the dairy product container 141.

The wind-blowing fan 160 according to an embodiment may be turned on when the driving period of the heater 150 elapses and the heater 150 is turned off to supply cool air inside the refrigerator compartment 21 to the dairy product container 141, thereby cooling down the dairy product contained in the dairy product container 141 to a temperature suitable to be provided to the user. In this case, fermentation may be progressed at a temperature above a preset temperature while the dairy product container 141 is cooled down by the operation of the wind-blowing fan 160.

As the temperature sensor 161 according to an embodiment measures temperature inside the dairy product maker 100, the controller 200 may control the operation of the heater 150 and the wind-blowing fan 160.

To this end, a thermistor may be used as the temperature sensor 161, and a negative temperature coefficient (NTC) type in which resistance decreases as temperature increases and a positive temperature coefficient (PTC) type in which resistance increases as temperature increases may be used. That is, the temperature sensor 161 may measure a temperature based on a change in output voltage in accordance with a temperature change.

Upon determination that there is an error in at least one of the heater 150, the wind-blowing fan 160, and the temperature sensor 161 of the dairy product maker 100, the controller 200 according to an embodiment may control the control panel 40 to display an error state.

Specifically, the controller 200 may determine that an error such as disconnection or a short circuit occurs in each of the heater 150, the wind-blowing fan 160, and the temperature sensor 161 based on an output from a sensor such as a voltage sensor, a current sensor, or a hole sensor and may control the control panel 40 to display the error state icon 44 indicating the error state of the component.

Based thereon, the user may recognize an error from the dairy product maker 100 more quickly and information on the component in which the error has occurred. Therefore, the dairy product maker 100 may be repaired more quickly and the dairy product maker 100 perform production of dairy products more accurately.

Upon receiving the control command for the dairy product maker 100 from the user via the control panel 40, the controller 200 according to an embodiment may control the dairy product maker 100 to produce a dairy product.

That is, the user may select the fermentation mode to ferment milk stored in the dairy product container 141 by touching the fermentation mode select icon 43 of the control panel 40, and the controller 200 may control the operation of the dairy product maker 100 in accordance with the selected fermentation mode.

In this case, the controller 200 may operate the heater 150 for a preset fermentation period in response to the control command. In addition, the controller 200 may turn off the heater 150 and turn on the wind-blowing fan 160 to cool down the dairy product container 141 when the preset fermentation period elapses. Upon completion of the cooling of the dairy product container 141, the wind-blowing fan 160 may be turned off.

That is, the control panel 40 may receive an input of the control command for the first fermentation mode or the control command for the second fermentation mode, and the controller 200 may operate the heater 150 for the fermentation period corresponding to the first fermentation mode upon receiving the control command for the first fermentation mode and operate the heater 150 for the fermentation period corresponding to the second fermentation mode upon receiving the control command for the second fermentation mode. As described above, the fermentation period corresponding to the first fermentation mode may be shorter than the fermentation period corresponding to the second fermentation mode.

In this case, when the control command for the dairy product maker 100 is input, the controller 200 may determine whether a temperature of the dairy product maker 100 is above a preset fermentation start temperature based on sensing results of the temperature sensor 161. The preset fermentation start temperature is a preset certain temperature suitable for fermentation of milk.

That is, in the case where the temperature of milk contained in the dairy product maker 100 is above a preset temperature, the controller 200 determines to proceed fermentation and starts to count a fermentation period during which fermentation is performed. In the case where the temperature of milk is below the preset temperature, the controller 200 does not count the fermentation period but turns on the heater 150 to heat the dairy product container 141 such that the temperature of milk reaches a preset temperature. When the temperature of milk reaches the preset temperature, the controller 200 determines to start fermentation by counting the progression of the fermentation period. In this case, the control over the operation of the heater 150 by the controller 200 refers to control over on/off operation of the heater 150.

In addition, upon receiving the control command for the second fermentation mode while the first fermentation mode is in progress, the controller 200 according to an embodiment may extend the operation period of the heater 150 to the fermentation period corresponding to the second fermentation mode.

On the contrary, upon receiving the control command for the first fermentation mode while the second fermentation mode is in progress, the controller 200 according to an embodiment may compare the fermentation period progressed according to the second fermentation mode with the fermentation period corresponding to the first fermentation mode. When the fermentation period progressed according to the second fermentation mode is shorter than the fermentation period corresponding to the first fermentation mode, the controller 200 may operate the heater 150 for the fermentation period corresponding to the first fermentation mode. When the fermentation period progressed according to the second fermentation mode is longer than the fermentation period corresponding to the first fermentation mode, the controller 200 may turn off the heater 150.

In addition, upon receiving the control command for the cooling mode is input in a state where the heater 150 operates, the controller 200 according to an embodiment may turn off the heater 150 and turn on the wind-blowing fan 160. On the contrary, upon receiving the control command for the first fermentation mode or the control command for the second fermentation mode in a state where the wind-blowing fan 160 operates, the controller 200 according to an embodiment may turn off the wind-blowing fan 160 and turn on the heater 150.

In addition, the controller 200 according to an embodiment may cool down the dairy product container 141 to a preset cooling temperature by turning off the heater 150 and turning on the wind-blowing fan 160 when a preset fermentation period elapses, and the controller 200 may further cool down the dairy product container 141 to a preset refrigeration temperature by controlling the operation of the wind-blowing fan 160 upon completion of the cooling of the dairy product container 141 to the cooling temperature. In this regard, the refrigeration temperature may be lower than the cooling temperature.

When the fermentation of milk is completed and the dairy product container 141 is cooled down to the preset cooling temperature, the controller 200 according to an embodiment may control the control panel 40 to display completion of fermentation and completion of cooling.

Also, when the fermentation of milk is completed and the dairy product container 141 is cooled down to the preset cooling temperature, the controller 200 according to an embodiment may control the notifier 50 to notify completion of fermentation and completion of cooling.

The operation of the controller 200 in the case where the temperature sensor 161 normally operates is described above. Hereinafter, an operation of the controller 200 in the case where an error occurs in the temperature sensor 161 or other components will be described.

Upon receiving the control command for the dairy product maker 100 is input via the control panel 40, the controller 200 according to an embodiment may also determine whether there is an error in the temperature sensor 161.

Specifically, the controller 200 may determine a case, in which an output from the temperature sensor 161 is 0 V or an input voltage of the temperature sensor 161, as an error of the temperature sensor 161 caused by disconnection or short circuit.

Also, the controller 200 may determine a case, in which the temperature sensor 161 outputs a temperature below a preset first reference temperature for a preset period of time or longer, as an error of the temperature sensor 161. For example, when a temperature corresponding to an output voltage of the temperature sensor 161 is below the preset first reference temperature for the preset period of time or longer in an NTC type temperature sensor 161 due to occurrence of high resistance error, the controller 200 may determine this case as an error of the temperature sensor 161.

Also, the controller 200 may determine a case, in which the temperature sensor 161 outputs a temperature above a preset second reference temperature for a preset reference period (e.g.: 3 hours) or longer, as an error of the temperature sensor 161. For example, when a temperature corresponding to an output voltage of the temperature sensor 161 is above a preset second reference temperature for a preset reference period or longer in an NTC type temperature sensor 161 due to occurrence of low resistance error, the controller 200 may determine this case as an error of the temperature sensor 161.

In this regard, the second reference temperature may correspond to a temperature that an internal temperature of the dairy product maker 100 may reach when the heater 150 is turned on and may be a temperature at which milk may be efficiently fermented (e.g., 37° C.).

When the temperature sensor 161 is normal, the controller 200 according to an embodiment may turn off the heater 150 after a lapse of a preset period from a time point at which the internal temperature reaches the preset temperature after the heater 150 is turned on. In this case, the preset temperature may be a temperature (e.g., 25° C.) suitable for fermentation of milk and correspond to a start point of counting for the preset period. However, according to the above-described embodiment, when the temperature sensor 161 is normal, the controller 200 may turn on the heater 150 for the preset fermentation period and start counting of the preset fermentation period in the case where the temperature of the dairy product maker 100 reaches the preset fermentation start temperature based on the outputs from the temperature sensor 161.

In addition, the controller 200 may control the wind-blowing fan 160 such that the internal temperature of the dairy product maker 100 reaches the preset refrigeration temperature after the heater 150 is turned off. That is, the controller 200 may control the dairy product contained in the dairy product container 141 to be maintained at the refrigeration temperature of the refrigerator compartment by controlling the wind-blowing fan 160, thereby serving the user with the dairy product in a ready-to-eat state.

Upon determination that there is an error in the temperature sensor 161, the controller 200 according to an embodiment does not perform the normal operation of controlling the heater 150 and the wind-blowing fan 160 based on output temperature from the temperature sensor 161 but may perform an emergency operation of controlling the heater 150 and the wind-blowing fan 160 based on time regardless of the output temperature of the temperature sensor 161.

Specifically, upon determination that there is an error in the temperature sensor 161, the controller 200 may turn off the heater 150 after a lapse of a preset first period (e.g.: 6 hours or 7 hours) from the time point at which the heater 150 is turned on and may operate the wind-blowing fan 160 for a preset second period (e.g.: 24 hours) from the time point at which the heater 150 is turned off.

The preset first period may correspond to the driving period of the heater 150 and may be set differently according to the fermentation mode input by the user. For example, a longer preset first period may be set for a thicker dairy product indicated based on the fermentation mode.

In this case, even when the controller 200 determines that the operation of the temperature sensor 161 returns to normal because the output temperature of the temperature sensor 161 after the heater 150 is turned on follows the internal temperature of the dairy product maker 100 in the case where the heater 150 is normally turned on, the controller 200 according to an embodiment may turn off the heater 150 after a lapse of the preset first period from the time point at which the heater 150 is turned on.

That is, the controller 200 may turn off the heater 150 after a lapse of the preset first period from the time point at which the heater 150 is turned on although the error of the temperature sensor 161 is resolved after the heater 150 is turned on.

As described above, even when there is an error in the temperature sensor 161, the refrigerator 1 according to an embodiment may provide the user with the function of producing a dairy product by controlling the heater 150 and the wind-blowing fan 160 based on time.

That is, even when the output of the temperature sensor 161 is inaccurate, the refrigerator 1 may provide the user with a dairy product by operating the heater 150 for the first period for fermentation of milk and operating the wind-blowing fan 160 for the second period for cooling the dairy product for refrigerated storage.

In addition, the controller 200 according to an embodiment may control the control panel 40 to display the dairy product production completion 42 after a lapse of the preset first period from the time point at which the heater 150 is turned on and a lapse of a preset third period (e.g.: one and a half hours) from the time point at which the heater 150 is turned off.

That is, the controller 200 may determine whether the preset third period elapses in the case where the internal temperature drops by cool air supplied to the dairy product container 141 by the wind-blowing fan 160 after the heater 150 is turned off and may control the control panel 40 to display the dairy product production completion 42 indicating that production of the dairy product is completed in the case where the preset third period elapses from the time point at which the heater 150 is turned off.

The preset third period may be shorter than the preset second period during which the wind-blowing fan 160 operates.

In this regard, the controller 200 according to an embodiment may also control the notifier 50 to output a notification corresponding to the dairy product production completion.

As described above, even when the output of the temperature sensor 161 is inaccurate, the refrigerator 1 may inform the user of production completion of the dairy product by displaying the dairy product production completion 42 after a period of time during which production of the dairy product is expected to be completed from the time point at which the heater 150 is turned off and the wind-blowing fan 160 is turned on.

The controller 200 according to an embodiment may repeatedly turn on and off the wind-blowing fan 160 for a fourth period (e.g.: 3 days) after a lapse of the preset second period from the time point at which the heater 150 is turned off and the wind-blowing fan 160 is turned on.

That is, the controller 200 may continuously supply cool air of the refrigerator compartment 21 to the dairy product container 141 by repeatedly turning on and off the wind-blowing fan 160 for the preset fourth period even after the preset second period during which the wind-blowing fan 160 operates. Therefore, the dairy product container 141 may be continuously supplied with cool air from the refrigerator compartment 21 so that the dairy product may be maintained in a temperature range for refrigeration of the dairy product. Finally, the refrigerator 1 may provide the user with the dairy product in a ready-to-eat state.

In this case, when the error of the temperature sensor 161 is resolved and the internal temperature of the dairy product maker 100 reaches the preset temperature before the preset fourth period elapses, the controller 200 may turn off the wind-blowing fan 160 according to an embodiment.

Specifically, when the controller 200 determines that the operation of the temperature sensor 161 returns to normal because the output temperature of the temperature sensor 161 when the wind-blowing fan 160 is repeatedly turned on and off follows the internal temperature of the dairy product maker 100 in a state where the wind-blowing fan 160 is normally, repeatedly turned on and off, the controller 200 may determine whether the internal temperature of the dairy product maker 100 reaches the preset temperature. Subsequently, the controller 200 may turn off the wind-blowing fan 160 before the preset fourth period elapses when the internal temperature of the dairy product maker 100 reaches the preset temperature.

The controller 200 may include at least one memory to store programs used to perform the operation described above and to be described below and at least one processor configured to execute the programs stored in the memory.

The operations of the refrigerator 1 and the dairy product maker 100 are described in detail above. Hereinafter, a process of producing a dairy product by the refrigerator 1 will be described in detail.

Figure 10:
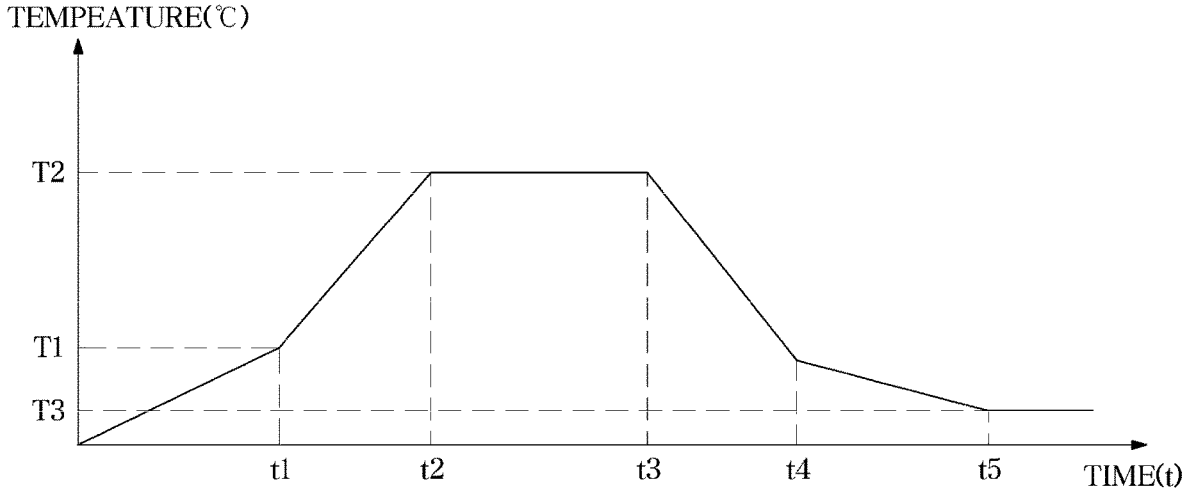
FIG. 10 is a graph illustrating production of a dairy product by a dairy product maker over time according to an embodiment of the present disclosure.
Figure 11:
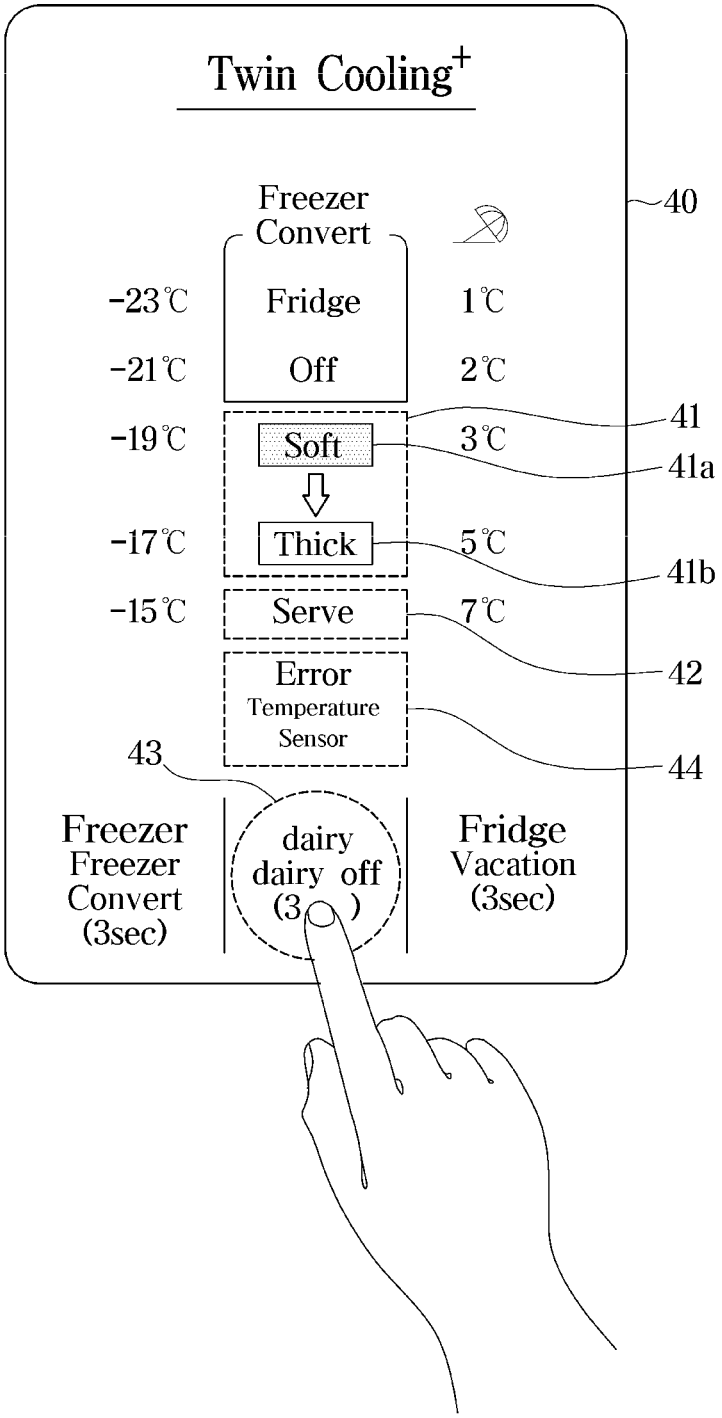
FIG. 11 shows a control panel and an input of a control command in the case where the second fermentation mode is input while the first fermentation mode is in progress according to an embodiment of the present disclosure.
Figure 12:
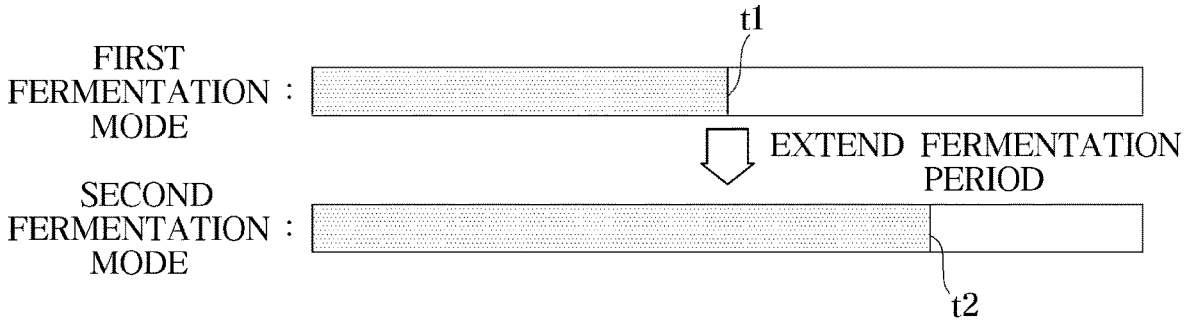
FIG. 12 shows a change in a fermentation period in the case where a second fermentation mode is input while a first fermentation mode is in progress according to an embodiment of the present disclosure.
Figure 13:
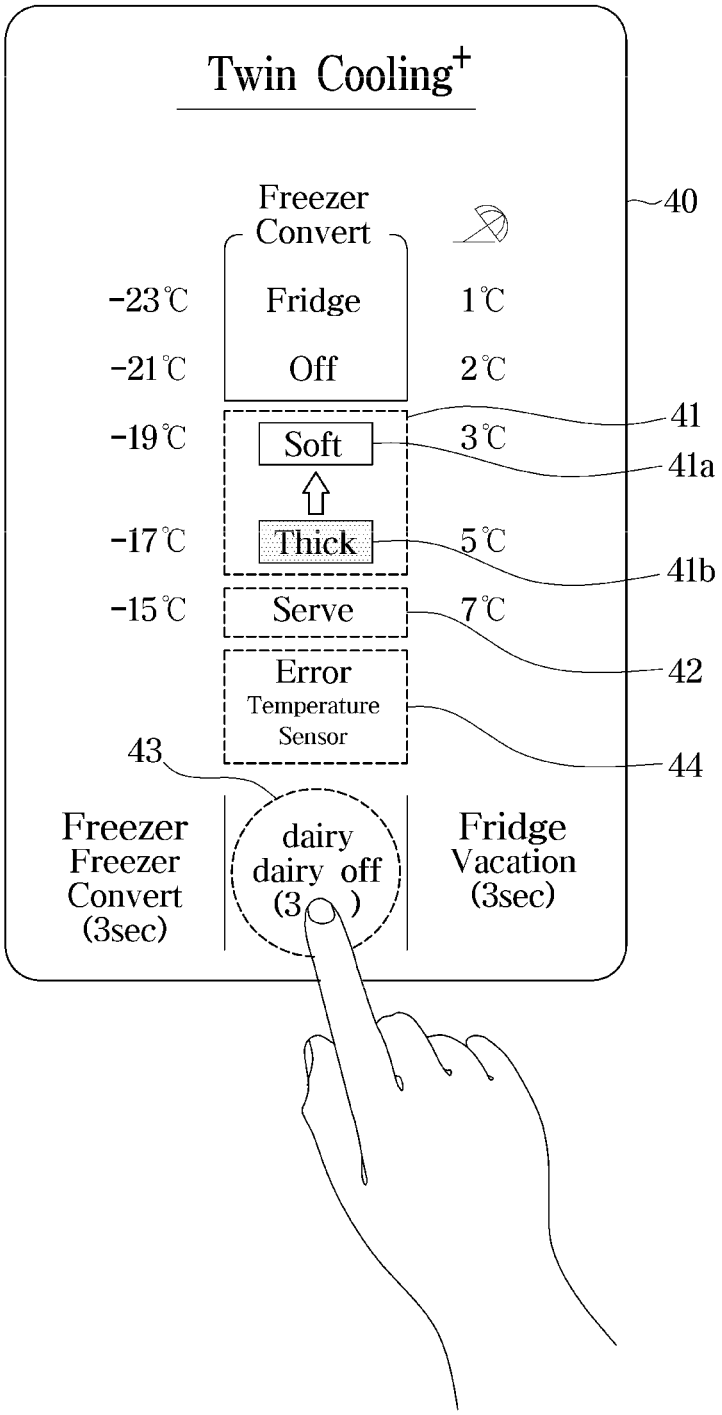
FIG. 13 shows a control panel and an input of a control command in the case where a first fermentation mode is input while a second fermentation mode is in progress according to an embodiment of the present disclosure.
Figure 14:
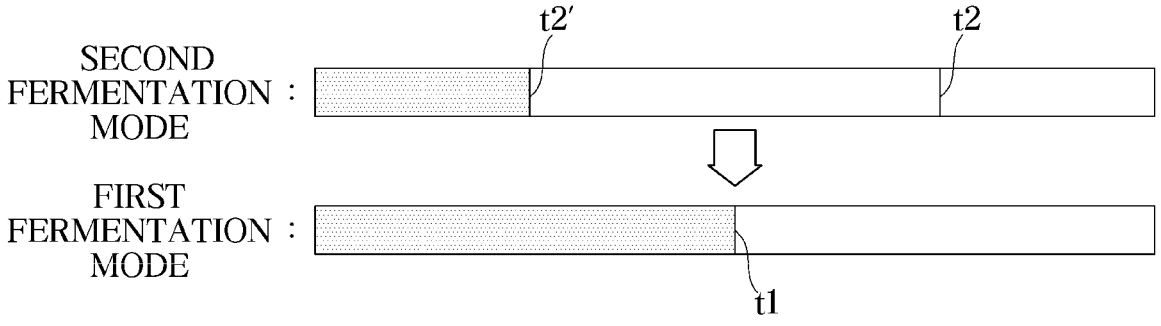
FIGS. 14 and 15 show changes in fermentation periods when a first fermentation mode is input while a second fermentation mode is in progress according to an embodiment of the present disclosure.
Figure 15:
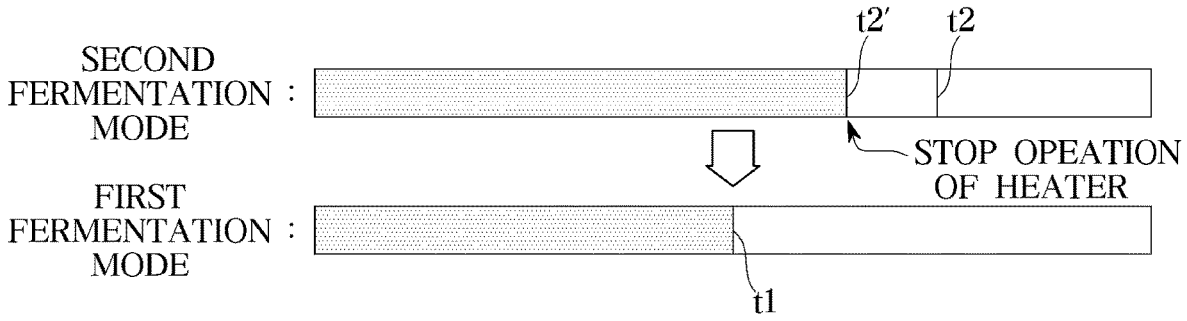

FIG. 10 is a graph illustrating production of a dairy product by the dairy product maker 100 over time according to an embodiment of the present disclosure. FIG. 11 shows a control panel 40 and an input of a control command in the case where the second fermentation mode is input while the first fermentation mode is in progress according to an embodiment of the present disclosure. FIG. 12 shows a change in fermentation period in the case where the second fermentation mode is input while the first fermentation mode is in progress according to an embodiment of the present disclosure. FIG. 13 shows a control panel 40 and an input of a control command the case where the first fermentation mode is input while the second fermentation mode is in progress according to an embodiment of the present disclosure. FIGS. 14 and 15 show changes in fermentation periods when the first fermentation mode is input while the second fermentation mode is in progress according to an embodiment of the present disclosure.

The control panel 40 may receive an input of a control command for the dairy product maker 100 from a user. That is, the user may select a fermentation mode to ferment milk stored in the dairy product container 141 by touching the fermentation mode select icon 43 of the control panel 40, and the controller 200 may control the operation of the dairy product maker 100 in accordance with the selected fermentation mode.

Upon receiving an input of a control command for the dairy product maker 100, the controller 200 may determine whether the internal temperature of the dairy product maker 100 is above the preset fermentation start temperature based on sensing results of the temperature sensor 161. In this regard, the preset fermentation start temperature is a preset certain temperature suitable for fermentation of milk.

That is, when the temperature of milk stored in the dairy product maker 100 is above the preset temperature, the controller 200 determines to proceed with fermentation and starts to count the fermentation period during which fermentation proceeds. When the temperature of milk is below the preset temperature, the controller 200 may heat the dairy product container 141 to increase the temperature of milk to reach a preset temperature by turning on the heater 150 without counting the fermentation period, and then determine to start fermentation and count the fermentation period from a time point at which the temperature of milk reaches the preset temperature. In this case, the control over the operation of the heater 150 by the controller 200 refers to control over on/off operation of the heater 150.

Referring to FIG. 10, when the internal temperature of the dairy product maker 100 is below a preset fermentation start temperature T1 based on the sensing results of the temperature sensor 161, the controller 200 increases the internal temperature of the dairy product maker 100 to the fermentation start temperature T1 by turning on the heater 150, and then determines that fermentation is started and counts the fermentation period from when the internal temperature reaches the fermentation start temperature T1. That is, the controller 200 performs fermentation for the fermentation period by heating the dairy product maker 100 in accordance with the fermentation mode input by the user. In this regard, the 'fermentation period' may be obtained by counting a period of time after the internal temperature of the dairy product maker 100 reaches the fermentation start temperature T1.

The fermentation start temperature T1 used to count the fermentation period by the controller 200 may be, for example, 25° C., but may vary according to settings.

Meanwhile, when the internal temperature of the dairy product maker 100 is above the preset fermentation start temperature T1 based on the sensing results of the temperature sensor 161, the controller 200 may operate the heater 150 to ferment milk for the preset fermentation period.

As shown in FIG. 10, the controller 200 may count the fermentation period from a time point t1 at which the internal temperature of the dairy product maker 100 reaches the fermentation start temperature T1 and operate the heater 150 to ferment milk at a preset fermentation temperature T2.

The fermentation temperature T2 for fermentation of milk may be, for example, 37° C., but may vary according to settings.

The controller 200 count the fermentation period from the time point t1 and control fermentation of milk to proceed at the preset fermentation temperature T2 until a time point t3 in accordance with the fermentation period corresponding the fermentation mode input by the user.

Meanwhile, the control panel 40 may receive an input of the control command for the first fermentation mode from the user. That is, the user may input the control command for the first fermentation mode by touching the fermentation mode select icon 43, and the first fermentation mode icon 41*a* may be displayed on the control panel 40 upon receiving the input of the control command for the first fermentation mode.

The controller 200 may proceed with fermentation of milk by operating the heater 150 for the fermentation period corresponding to the input first fermentation mode.

As shown in FIG. 11, while the first fermentation mode of the dairy product maker 100 is in progress, the user may input a control command for the second fermentation mode. The user may input the control command for the second fermentation mode to produce a thick dairy product while milk is fermented in the first fermentation mode in the dairy product maker 100 to produce a soft dairy product.

That is, the user may input the control command for the second fermentation mode by touching the fermentation mode select icon 43 while the first fermentation mode is in progress, and the second fermentation mode icon 41*b* may be displayed on the control panel 40 upon receiving the input of the control command for the second fermentation mode.

Upon receiving the input of the control command for the second fermentation mode, the controller 200 may extend the operation period of the heater 150 such that milk is fermented during the fermentation period corresponding to the second fermentation mode.

As shown in FIG. 12, because the fermentation period t2 corresponding to the second fermentation mode to produce a thick dairy product is longer than the fermentation period t1 corresponding to the first fermentation mode to produce a soft dairy product, the controller 200 may operate the heater 150 and extend the fermentation period from t1 to t2 upon receiving the input of the control command for the second fermentation mode.

Also, the control panel 40 may receive an input of a control command for the second fermentation mode from the user. That is, as described above, the user may input the control command for the second fermentation mode by touching the fermentation mode select icon 43, and the second fermentation mode icon 41*b* may be displayed on the control panel 40 upon receiving the input of the control command for the second fermentation mode.

The controller 200 may perform fermentation of milk by operating the heater 150 for the fermentation period corresponding to the second fermentation mode.

As shown in FIG. 13, while the second fermentation mode of the dairy product maker 100 is in progress, the user may input a control command for the first fermentation mode. The user may input the control command for the first fermentation mode to produce a soft dairy product while milk is fermented in the second fermentation mode in the dairy product maker 100 to produce a thick dairy product.

That is, the user may input the control command for the first fermentation mode by touching the fermentation mode select icon 43 while the second fermentation mode is in progress, and the first fermentation mode icon 41*a* may be displayed on the control panel 40 upon receiving the input of the control command for the first fermentation mode.

Upon receiving the input of the control command for the first fermentation mode while the second fermentation mode is in progress, the controller 200 may compare the fermentation period progressed according to the second fermentation mode with the fermentation period corresponding to the first fermentation mode.

When the fermentation period progressed according to the second fermentation mode is shorter than the fermentation period corresponding to the first fermentation mode controller 200 based on the comparison results, the controller 200 may maintain the on-state of the heater 150 to ferment milk during the fermentation period corresponding to the first fermentation mode.

That is, as shown in FIG. 14, an actual fermentation period progressed while fermentation is in progress for the fermentation period t2 corresponding to the second fermentation mode to produce a thick dairy product is t2'. In this case, when the control command for the first fermentation mode is input by the user, the fermentation period corresponding to the first fermentation mode is t1, and thus the actual fermentation period t2' progressed according to the second fermentation mode is shorter than the fermentation period corresponding to the first fermentation mode t1. Therefore, the controller 200 may operate the heater 150 to continue the fermentation of milk for the fermentation period corresponding to the first fermentation mode t1.

On the contrary, in the case where the fermentation period progressed according to the second fermentation mode is longer than the fermentation period corresponding to the first fermentation mode based on the comparison results, the controller 200 may complete fermentation of milk by turning off the heater 150.

That is, as shown in FIG. 15, the actual fermentation period t2' progressed during the fermentation period t2 corresponding to the second fermentation mode is longer than the fermentation period corresponding to the first fermentation mode t1 input by the user unlike the example shown in FIG. 14.

Because the user inputs the control command for the first fermentation mode to convert the fermentation mode into the first fermentation mode to produce a soft dairy product during fermentation of milk in the second fermentation mode, the controller 200 may complete fermentation of milk by turning off the heater 150 at a time point when the control command for the first fermentation mode is input.

As described above, the user may input a control command to convert the fermentation mode during fermentation of milk in the dairy product maker 100 in accordance with the control of the controller 200 and complete fermentation by controlling the fermentation period of milk in accordance with the fermentation period corresponding to the fermentation mode input by the user and the fermentation period progressed prior to the input of the control command to convert the fermentation mode.

Referring back to FIG. 10, when the fermentation period corresponding to the fermentation mode elapsed, the controller 200 may turn off the heater 150 and cool the dairy product container 141 by turning on the wind-blowing fan 160.

That is, as shown in FIG. 10, when the dairy product maker 100 fermented milk at the preset fermentation temperature and the preset fermentation period has elapsed, the controller 200 may turn off the heater 150 at a time point t3 at which the preset fermentation period has elapsed and cool down the dairy product stored in the dairy product container 141 by controlling the wind-blowing fan 160, thereby cooling the dairy product to a temperature T1 suitable for serving to the user. In this case, fermentation may also progress at a certain temperature or above while the wind-blowing fan 160 operates to cool down the dairy product container 141.

The controller 200 may determine whether the temperature of the dairy product container 141 reaches the present cooling temperature by cooling down the dairy product container 141. When the cooling down of the dairy product is completed, the controller 200 may display the dairy product production completion icon 42 indicating that production of the dairy product is completed by fermenting milk and by cooling the fermented dairy product on the control panel 40. That is, when the dairy product container 141 reaches the preset cooling temperature, the controller 200 may determine that cooling of the dairy product is completed and control the control panel 40 to display the dairy product production completion icon 42.

In addition, upon completion of the cooling of the dairy product, the controller 200 may control the notifier 50 to output a notification regarding the completion of milk fermentation and completing of cooling of the dairy product by the dairy product maker 100.

Even after the production of the dairy product is completed and the dairy product is in a state suitable for serving to the user, the controller 200 may control the operation of the wind-blowing fan 160 to cool the dairy product container 141 to a preset refrigeration temperature T3 to keep the dairy product refrigerated.

That is, because the controller 200 controls the wind-blowing fan 160 to keep the dairy product stored in the dairy product container 141 at the refrigeration temperature T3 of the refrigerator compartment, the dairy product may be served in a ready-to-eat state.

Meanwhile, the user may input a control command for the cooling mode via the control panel 40 while fermentation is in progress in the dairy product maker 100 according to the operation of the heater 150. Upon receiving the input of the control command for the cooling mode, the controller 200 may turn off the heater 150 and turn on the wind-blowing fan 160 regardless of the progress of fermentation to cool down the dairy product container 141.

Meanwhile, in the case where a thermal load of the refrigerator compartment 21 increases in response to the operation of wind-blowing fan 160, the controller 200 may control the refrigerating operation of the refrigerator compartment 21 to be changed in response to the increased thermal load.

Also, the user may input the control command for the first fermentation mode or the control command for the second fermentation mode via the control panel 40 while the dairy product cooling mode is performed by the operation of the wind-blowing fan 160. Upon receiving the input of the control command for fermentation, the controller 200 may turn off the wind-blowing fan 160 and turn on the heater 150 to ferment milk during the fermentation period corresponding to the first fermentation mode or the fermentation period corresponding to the second fermentation mode.

That is, the user may input the control command for the cooling mode while fermentation of milk is in progress to stop fermentation of the dairy product and start cooling of the dairy product. On the contrary, the user may input the control command for the fermentation mode while the cooling of the dairy product is in progress to stop cooling of the dairy product and start fermentation of the dairy product.

As described above, the refrigerator 1 according to an embodiment provides the user with effects on easily controlling the operation of fermenting milk and the operation of cooling dairy products performed by the dairy product maker 100 via the control panel 40 and easily recognizing the operating state of the dairy product maker 100. In addition, an effect on serving dairy products that suit taste of the user may be provided by controlling fermentation and cooling of the dairy products via the control panel 40.

The operation of the controller 200 in the case where the temperature sensor 161 normally operates is described above. Hereinafter, an operation of controller 200 in the case where there is an error in the temperature sensor 161 or other components will be described.

Figure 16:
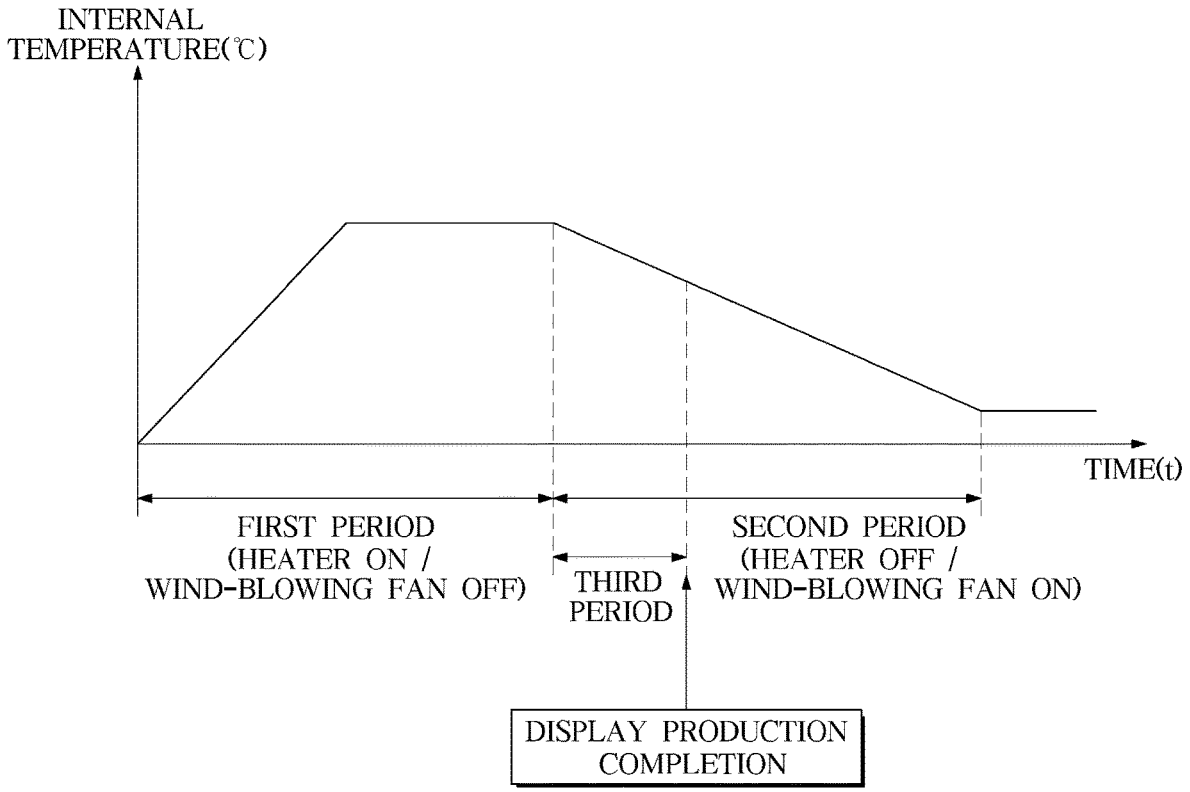
FIG. 16 is a graph illustrating production of a dairy product in the case where a refrigerator according to an embodiment of the present disclosure determines that there is an error in a temperature sensor.
Figure 17:
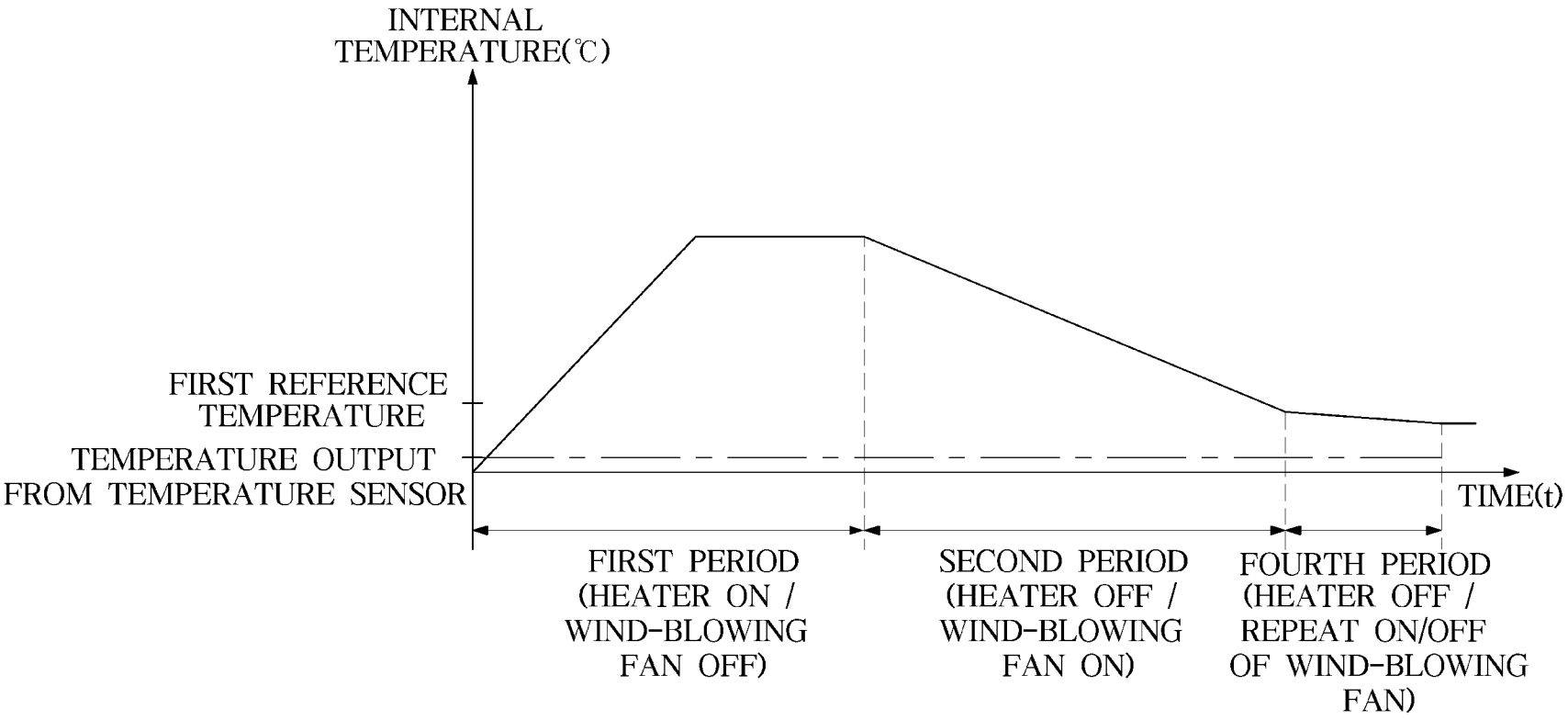
FIG. 17 is a graph illustrating production of a dairy product in the case where a refrigerator continuously outputs a low temperature due to an error occurring in a temperature sensor.
Figure 18:
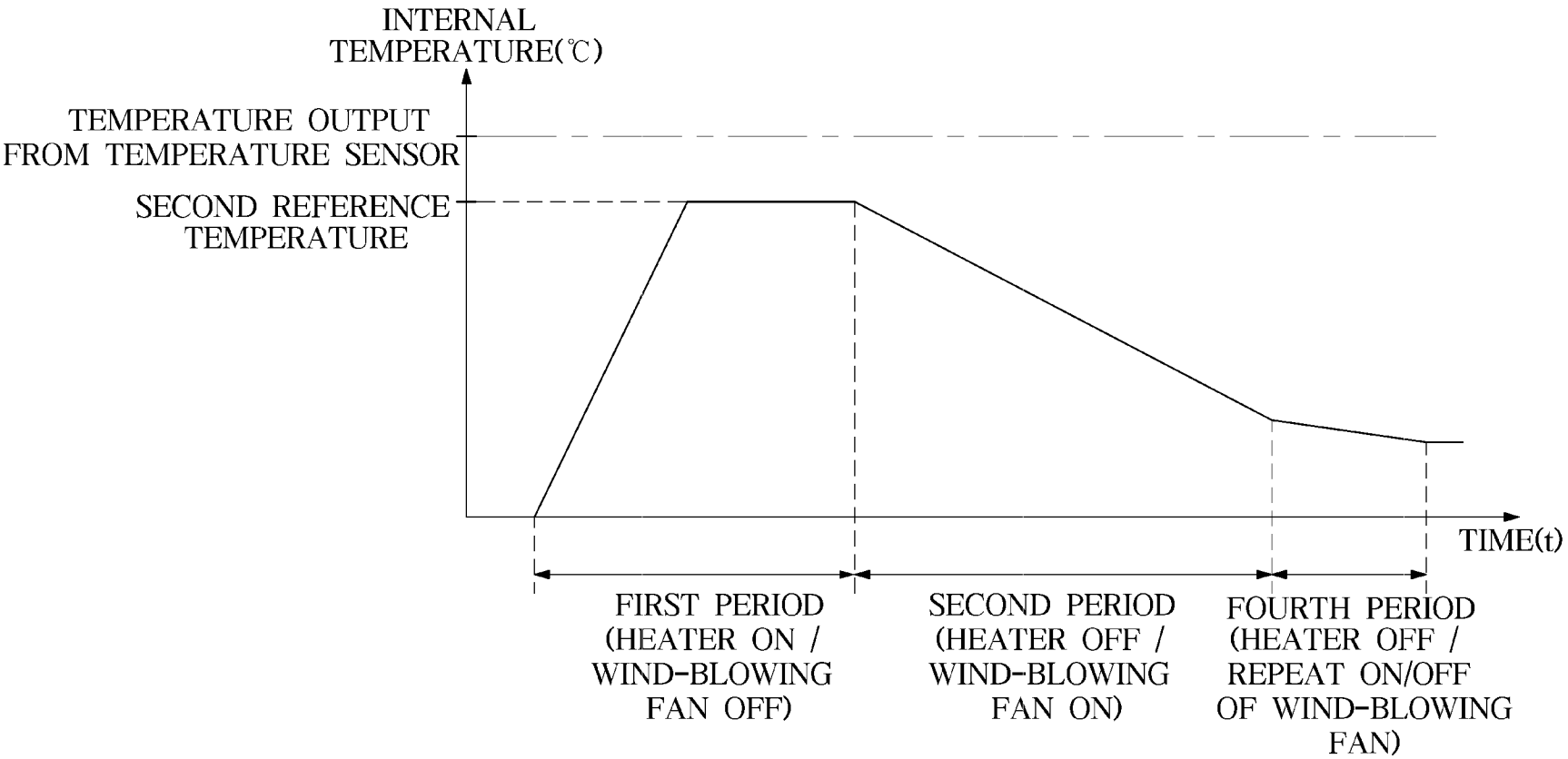
FIG. 18 is a graph illustrating production of a dairy product in the case where a refrigerator continuously outputs a high temperature due to an error occurring in a temperature sensor.
Figure 19:
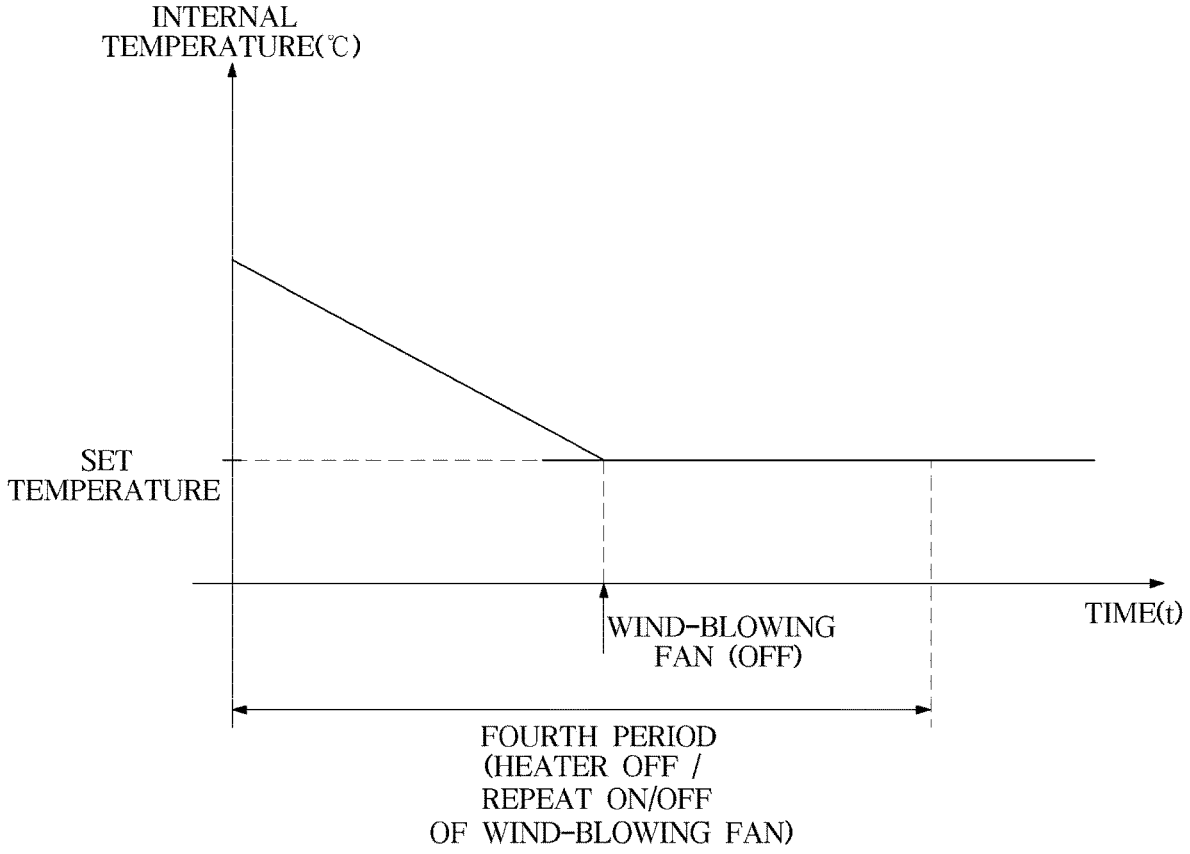
FIG. 19 is a graph indicating a case in which an output of a temperature sensor is determined as normal while on- and off-operations of a wind-blowing fan is repeated by a refrigerator according to an embodiment of the present disclosure.

FIG. 16 is a graph illustrating production of a dairy product in the case where the refrigerator 1 according to an embodiment of the present disclosure determines that there is an error in the temperature sensor 161. FIG. 17 is a graph illustrating production of a dairy product in the case where the refrigerator 1 continuously outputs a low temperature due to an error occurring in the temperature sensor 161. FIG. 18 is a graph illustrating production of a dairy product in the case where the refrigerator 1 continuously outputs a high temperature due to an error occurring in the temperature sensor 161. FIG. 19 is a graph indicating a case in which an output of the temperature sensor 161 is determined as normal while the on- and off-operations of the wind-blowing fan 160 is repeated by the refrigerator 1 according to an embodiment of the present disclosure.

Referring to FIGS. 16 to 18, upon receiving a control command for the dairy product maker 100 from the user via the control panel 40, the controller 200 according to an embodiment may control the dairy product maker 100 to produce a dairy product.

That is, the user may select a fermentation mode to ferment milk stored in the dairy product container 141 by touching the fermentation mode select icon 43 of the control panel 40, and the controller 200 may control the operation of the dairy product maker 100 in accordance with the selected fermentation mode.

Upon receiving the control command for the dairy product maker 100 via the control panel 40, the controller 200 according to an embodiment may determine whether there is an error in the temperature sensor 161.

Specifically, the controller 200 may determine a case, in which an output from the temperature sensor 161 is 0 V or an input voltage of the temperature sensor 161, as an error of the temperature sensor 161 caused by disconnection or short circuit.

Also, as shown in FIG. 17, the controller 200 may determine a case, in which the temperature sensor 161 outputs a temperature below a preset first reference temperature for a preset period or longer, as an error of the temperature sensor 161. For example, when a temperature corresponding to an output voltage of the temperature sensor 161 is below the preset first reference temperature for the preset period or longer in an NTC type temperature sensor 161 due to occurrence of high resistance error, the controller 200 may determine this case as an error of the temperature sensor 161.

Also, as shown in FIG. 18, the controller 200 may determine a case, in which the temperature sensor 161 outputs a temperature above a preset second reference temperature for a preset reference period (e.g.: 3 hours) or longer, as an error of the temperature sensor 161. For example, when a temperature corresponding to an output voltage of the temperature sensor 161 is above a preset second reference temperature for a preset reference period or longer in an NTC type temperature sensor 161 due to occurrence of low resistance error, the controller 200 may determine this case as an error of the temperature sensor 161.

In this regard, the second reference temperature may correspond to a temperature that an internal temperature of the dairy product maker 100 may reach when the heater 150 operates and may correspond to a temperature at which milk may be efficiently fermented (e.g., 37° C.).

Upon determination that there is an error in the temperature sensor 161, the controller 200 according to an embodiment does not perform the normal operation of controlling the heater 150 and the wind-blowing fan 160 based on output temperature from the temperature sensor 161 but may perform an emergency operation of controlling the heater 150 and the wind-blowing fan 160 based on time regardless of the output temperature of the temperature sensor 161.

Specifically, upon determination that there is an error in the temperature sensor 161, the controller 200 may turn off the heater 150 after a lapse of a preset first period (e.g.: 6 hours or 7 hours) from the time point at which the heater 150 is turned on and may operate the wind-blowing fan 160 for a preset second period (e.g.: 24 hours) from the time point at which the heater 150 is turned off.

In other words, the heater 150 operate and the wind-blowing fan 160 is turned off during the preset first period, and the heater 150 is turned off and the wind-blowing fan 160 operate during the preset second period.

The preset first period may correspond to the driving period of the heater 150 and may be set differently according to the fermentation mode input by the user. For example, a longer preset first period may be set for a thicker dairy product based on the fermentation mode.

In this case, upon receiving the control command for the dairy product maker 100 via the control panel 40, the controller 200 may turn on the heater 150 in the case where the internal temperature of the dairy product maker 100 is below the preset temperature based on the outputs from the temperature sensor 161. In addition, upon determination that there is an error in the temperature sensor 161, the controller 200 may turn on the heater 150 regardless of the internal temperature of the dairy product maker 100.

For example, upon determination that there is an error in the temperature sensor 161 due to disconnection or a short circuit because the output from the temperature sensor 161 is 0 V or the input voltage of the first frame 16, the controller 200 may turn on the heater 150 without time delay from the input of the control command. That is, the controller 200 may determine the error of the temperature sensor 161 caused by disconnection or a short circuit based on the output voltage of the temperature sensor 161 without time delay from the input of the control command and may turn on the heater 150 immediately after determining the error.

In addition, as shown in FIG. 17, in the case where the temperature sensor 161 outputs a temperature below the first reference temperature, the controller 200 may turn on the heater 150 without time delay from the input of the control command. In this case, the controller 200 may determine that an error occurs in the temperature sensor 161 in the case where the temperature sensor 161 outputs a temperature below the preset first reference temperature for the preset reference period or longer even after the heater 150 is turned on and may turn off the heater 150 after the lapse of the preset first period from the time point at which the heater 150 is turned on.

In addition, as shown in FIG. 18, in the case where the temperature sensor 161 outputs a temperature above the preset second reference temperature for the preset reference period (e.g.: 3 hours) or longer, the controller 200 may determine that an error occurs in the temperature sensor 161 and may turn on the heater 150. Accordingly, in the case where the temperature sensor 161 continuously outputs a high temperature, the heater 150 may not be turned on immediately after the control command but turned on after determining the error, so that there may be a time delay between the input of the control command and the operation of the heater 150.

As described above, the controller 200 may control the heater 150 to operate for a certain period of time (first period) even when an error occurs in the temperature sensor 161 to provide heat sufficient for fermentation of milk contained in the dairy product container 141.

In this regard, the controller 200 may also turn off the heater 150 after a lapse of the preset first period from the time point at which the heater 150 is turned on even when the controller 200 determines that the operation of the temperature sensor 161 returns to normal because the output temperature of the temperature sensor 161 after the heater 150 is turned on follows the internal temperature of the dairy product maker 100 in the case where the heater 150 is normally turned on.

That is, the controller 200 may turn off the heater 150 after a lapse of the preset first period from the time point at which the heater 150 is turned on although the error of the temperature sensor 161 is resolved after the heater 150 is turned on.

As described above, even when there is an error in the temperature sensor 161, the refrigerator 1 according to an embodiment may provide the user with the function of producing a dairy product by controlling the heater 150 and the wind-blowing fan 160 based on time.

That is, even when the output of the temperature sensor 161 is inaccurate, the refrigerator 1 may provide the user with dairy products by operating the heater 150 for the first period to ferment milk and operating the wind-blowing fan 160 for the second period to cool down the dairy product to keep the dairy product refrigerated.

In addition, as shown in FIG. 16, the controller 200 according to an embodiment may control the control panel 40 to display the dairy product production completion 42 after a lapse of the preset first period from the time point at which the heater 150 is turned on and a lapse of a preset third period (e.g.: one and a half hours) from the time point at which the heater 150 is turned off.

That is, the controller 200 may determine whether the preset third period elapses in the case where the internal temperature of the dairy product maker 100 drops due to cool air supplied to the dairy product container 141 by the wind-blowing fan 160 after the heater 150 is turned off and may control the control panel 40 to display the dairy product production completion 42 indicating that production of the dairy product is completed in the case where the preset third period elapses from the time point at which the heater 150 is turned off.

The preset third period may be shorter than the preset second period during which the wind-blowing fan 160 operates.

In this regard, the controller 200 may also control the notifier 50 to output a notification corresponding to the dairy product production completion according to an embodiment.

As described above, even when the output of the temperature sensor 161 is inaccurate, the refrigerator 1 may inform the user of production completion of the dairy product by displaying the dairy product production completion 42 after a period of time during which production of the dairy product is expected to be completed from the time point at which the heater 150 is turned off and the wind-blowing fan 160 is turned on.

The controller 200 according to an embodiment may repeatedly turn on and off the wind-blowing fan 160 for a fourth period (e.g.: 3 days) after a lapse of the preset second period from the time point at which the heater 150 is turned off and the wind-blowing fan 160 is turned on.

That is, the controller 200 may continuously supply cool air of the refrigerator compartment 21 to the dairy product container 141 by repeatedly turning on and off the wind-blowing fan 160 for the preset fourth period even after the lapse of the preset second period during which the wind-blowing fan 160 operates. Therefore, the dairy product container 141 may be continuously supplied with cool air from the refrigerator compartment 21 so that the dairy product may be maintained in a refrigeration temperature range for the dairy product. Finally, the refrigerator 1 may provide the user with the dairy product in a ready-to-eat state.

In this case, as shown in FIG. 19, when the error of the temperature sensor 161 is resolved and the internal temperature of the dairy product maker 100 reaches the preset temperature before the preset fourth period elapses, the controller 200 may turn off the wind-blowing fan 160 according to an embodiment.

Specifically, when the controller 200 determines that the operation of the temperature sensor 161 returns to normal because the output temperature of the temperature sensor 161 when the wind-blowing fan 160 is repeatedly turned on and off follows the internal temperature of the dairy product maker 100 in a state where the wind-blowing fan 160 is normally, repeatedly turned on and off, the controller 200 may determine whether the internal temperature of the dairy product maker 100 reaches the preset temperature. Subsequently, the controller 200 may turn off the wind-blowing fan 160 when the internal temperature of the dairy product maker 100 reaches the preset temperature even before the preset fourth period elapses.

Hereinafter, a method of controlling the refrigerator 1 according to an embodiment will be described. In the method of controlling the refrigerator 1, the refrigerator 1 previously described above may be used. Therefore, the descriptions given above with reference to FIGS. 1 to 19 may also be applied to the method of controlling the refrigerator 1 in the same manner.

Figure 20:
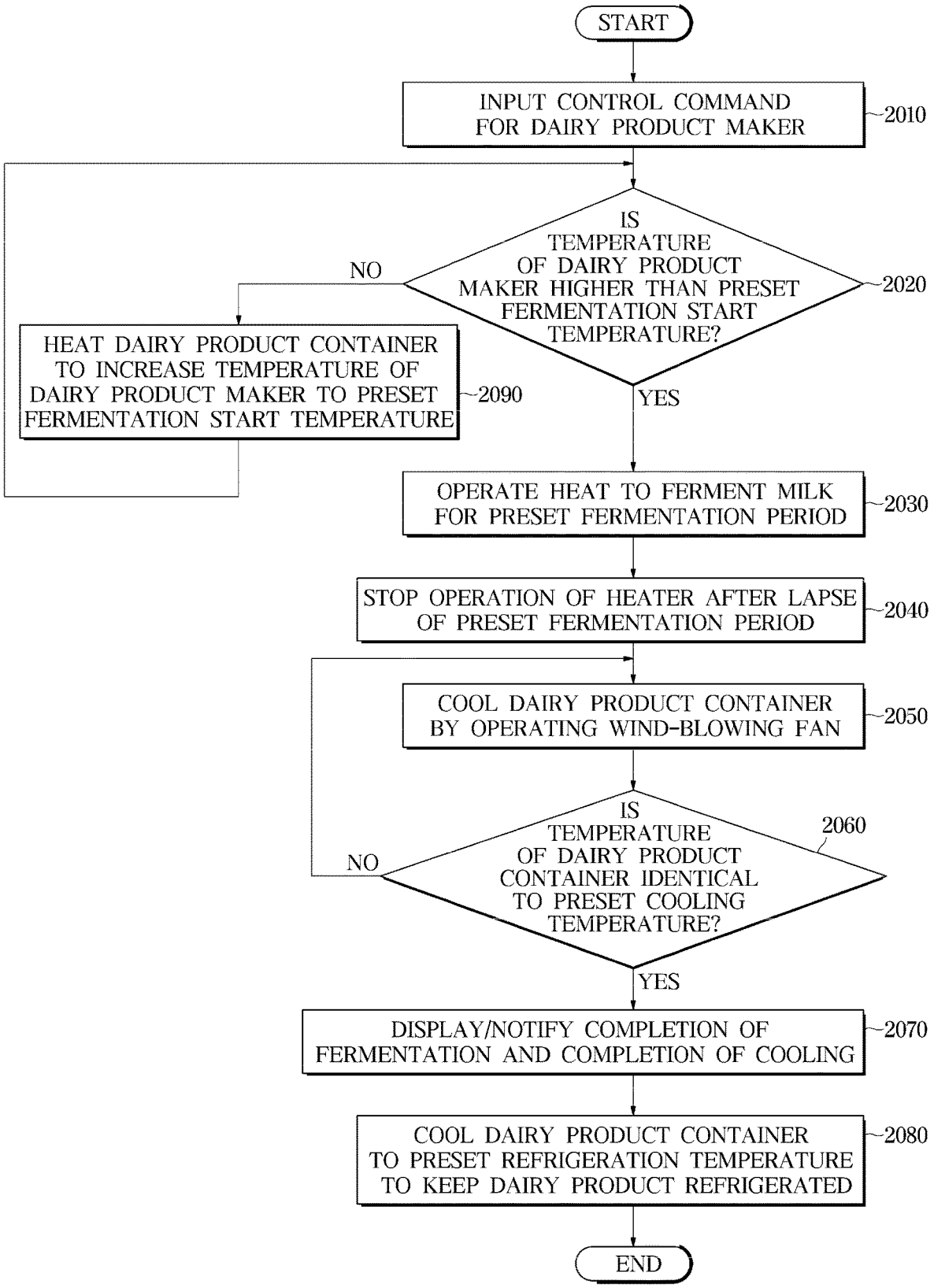
FIG. 20 is a flowchart of a process of producing a dairy product in a method of controlling a refrigerator according to an embodiment of the present disclosure.

FIG. 20 is a flowchart of a process of producing a dairy product in a method of controlling a refrigerator according to an embodiment of the present disclosure.

The refrigerator 1 according to an embodiment may receive an input of the control command for the dairy product maker 100 from the user (2010). That is, the user may select a fermentation mode to ferment milk stored in the dairy product container 141 by touching the fermentation mode select icon 43 of the control panel 40, and the controller 200 may control the operation of the dairy product maker 100 in accordance with the selected fermentation mode.

In the case where the temperature of the dairy product maker 100 is above the preset fermentation start temperature (Yes of 2020), the refrigerator 1 according to an embodiment may operate (turn on) the heater to ferment milk for the preset fermentation period (2030). In addition, in the case where the temperature of the dairy product maker 100 is below the preset fermentation start temperature (No of 2020), the refrigerator 1 according to an embodiment may heat the dairy product container 141 to increase the temperature of the dairy product maker 100 reaches the fermentation start temperature (2090).

That is, when the temperature of milk stored in the dairy product maker 100 is above a certain temperature, the controller 200 determines to proceed with fermentation and starts to count the fermentation period during which fermentation proceeds. When the temperature of milk is below a certain temperature, the controller 200 may heat the dairy product container 141 to increase the temperature of milk to reach the preset temperature by turning on the heater 150 without counting the fermentation period, and then determine to start fermentation and start to count the fermentation period from a time point at which the temperature of milk reaches the preset temperature.

The refrigerator 1 according to an embodiment may stop the operation of the heater 150 after a lapse of the preset fermentation period (2040) and cool down the dairy product container 141 by operating the wind-blowing fan 160 (2050).

That is, the controller 200 may turn off the heater 150 at a time point when the preset fermentation period elapses, and cool down the dairy product stored in the dairy product container 141 by controlling the operation of the wind-blowing fan 160. In this case, fermentation may proceed at a temperature above a certain temperature while the dairy product container 141 is cooled down by operating the wind-blowing fan 160.

When the temperature of the dairy product container 141 reaches the preset cooling temperature (Yes of 2060), the refrigerator 1 according to an embodiment may display/notify completion of fermentation and completion of cooling (2070).

That is, when the temperature of the dairy product container 141 reaches the preset cooling temperature, the controller 200 may determine that the cooling of the dairy product is completed and control the control panel 40 to display the dairy product production completion icon 42. In addition, when the cooling of the dairy product is completed, the controller 200 may control the notifier 50 to output a notification indicating that fermentation of milk of the dairy product maker 100 and cooling of the dairy product are completed.

The refrigerator 1 according to an embodiment may cool down the dairy product container 141 to the preset refrigeration temperature to keep the dairy product refrigerated (2080).

That is, even after the production of the dairy product is completed and the dairy product is in a state suitable for serving to the user, the controller 200 may control the operation of the wind-blowing fan 160 to cool the dairy product container 141 to the preset refrigeration temperature to keep the dairy product refrigerated. In other words, the controller 200 controls the wind-blowing fan 160 to keep the dairy product stored in the dairy product container 141 at the refrigeration temperature of the refrigerator compartment, thereby providing the dairy product in a ready-to-eat state.

Figure 21:
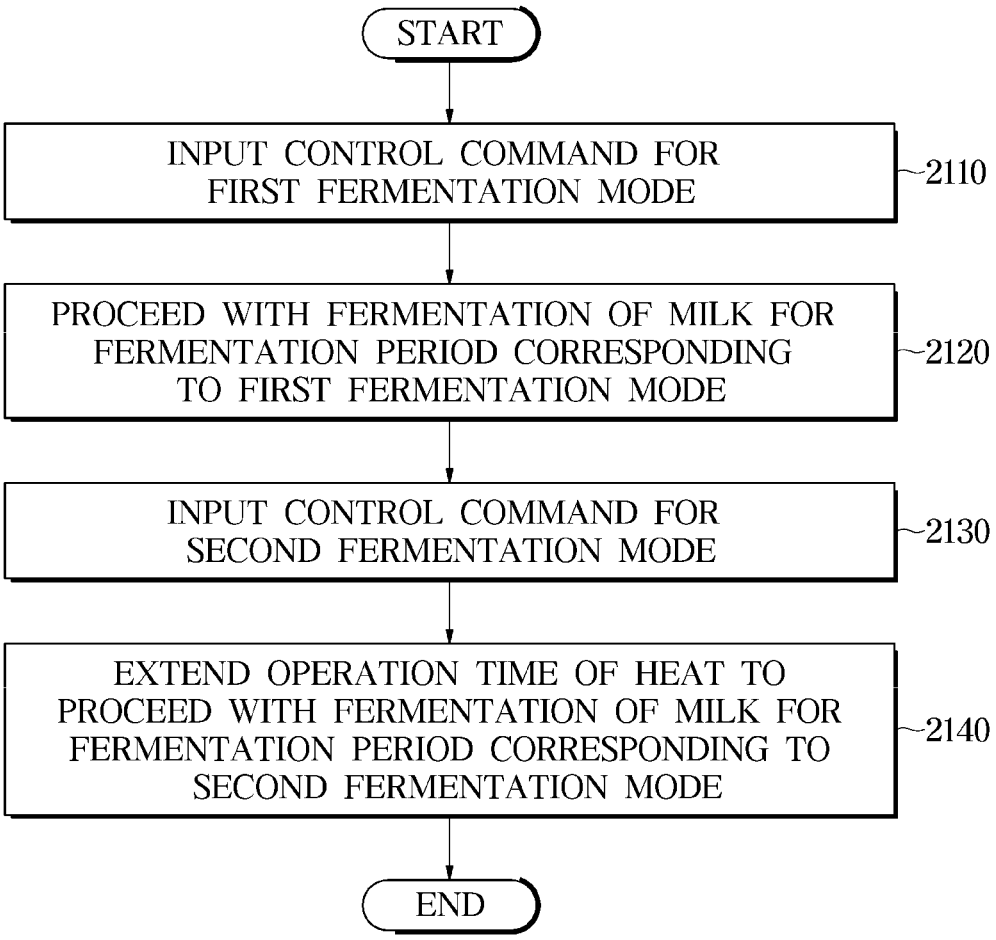
FIG. 21 is a flowchart of a case in which a second fermentation mode is input while a first fermentation mode is in progress in a method of controlling a refrigerator according to an embodiment of the present disclosure.

FIG. 21 is a flowchart of a case in which a second fermentation mode is input while a first fermentation mode is in progress in the method of controlling the refrigerator 1 according to an embodiment of the present disclosure.

Referring to FIG. 21, the refrigerator 1 according to an embodiment may receive an input of the control command for the first fermentation mode from the user via the control panel 40 (2110).

In this case, the refrigerator 1 may proceed with fermentation of milk for the fermentation period corresponding to the first fermentation mode (2120). That is, the controller 200 may proceed with fermentation of milk by operating the heater 150 for the fermentation period corresponding to the input first fermentation mode.

In this regard, the refrigerator 1 may receive an input of the control command for the second fermentation mode from the user via the control panel 40 while the first fermentation mode is in progress (2130). That is, the user may input the control command for the second fermentation mode to produce a thick dairy product while the dairy product maker 100 performs fermentation of milk in the first fermentation mode to produce a soft dairy product.

The refrigerator 1 according to an embodiment may extend the operation period of the heater 150 to ferment milk during the fermentation period corresponding to the second fermentation mode (2140).

That is, because the fermentation period of milk corresponding to the second fermentation mode to produce a thick dairy product is longer than the fermentation period of milk corresponding to the first fermentation mode to produce a soft dairy product, the controller 200 may operate the heater 150 by extending the fermentation period of milk from the fermentation mode corresponding to the first fermentation mode to the fermentation period corresponding to the second fermentation mode upon receiving an input of the control command for the second fermentation mode.

Figure 22:
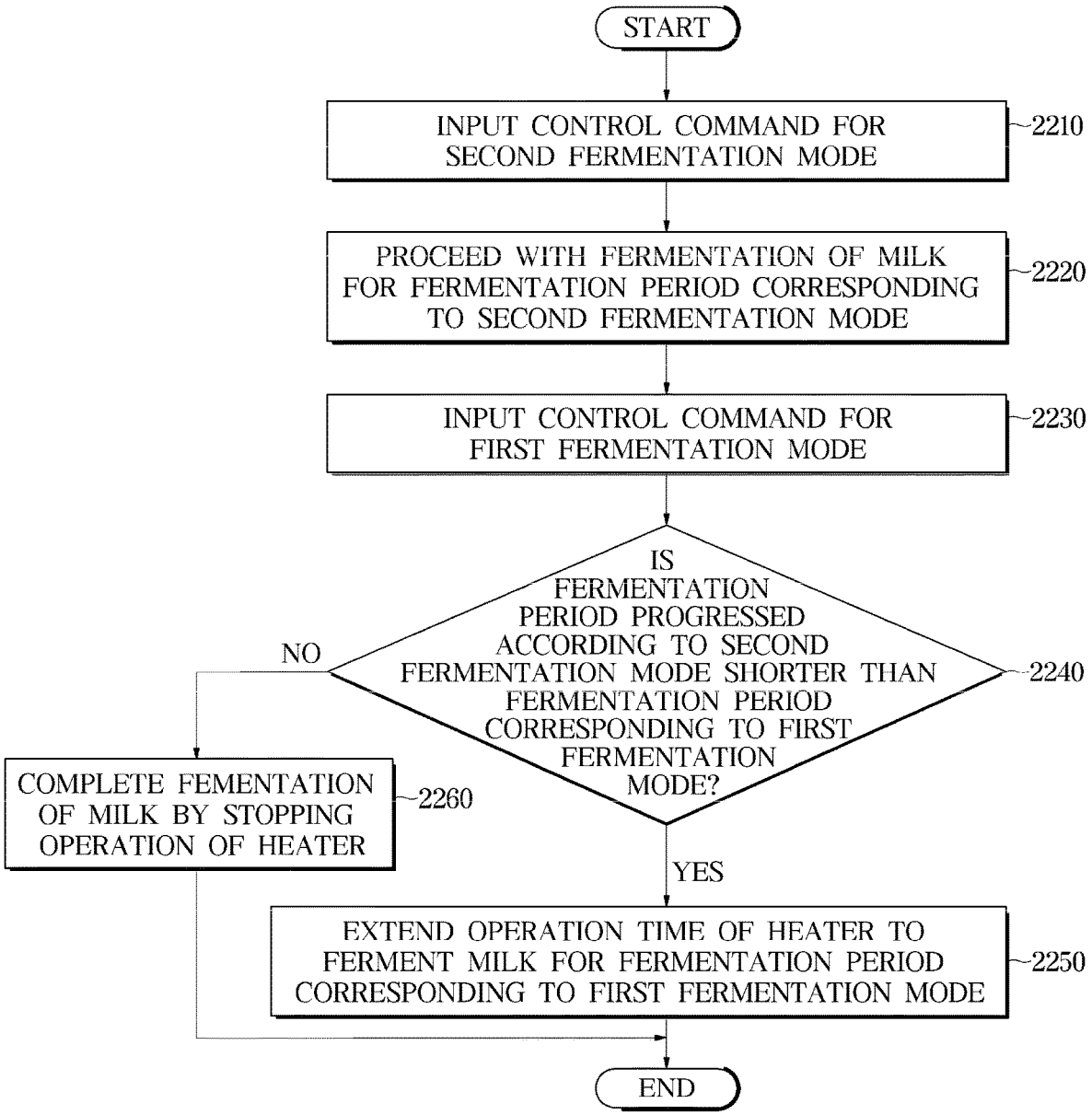
FIG. 22 is a flowchart of a case in which a first fermentation mode is input while a second fermentation mode is in progress in a method of controlling a refrigerator according to an embodiment of the present disclosure.

FIG. 22 is a flowchart of a case in which a first fermentation mode is input while a second fermentation mode is in progress in the method of controlling the refrigerator 1 according to an embodiment of the present disclosure.

Referring to FIG. 22, the refrigerator 1 according to an embodiment may receive an input of the control command for the second fermentation mode from the user via the control panel 40 (2210).

In this case, the refrigerator 1 may proceed with fermentation of milk for the fermentation period corresponding to the second fermentation mode (2220). That is, the controller 200 may proceed with fermentation of milk by operating the heater 150 for the fermentation period corresponding to the input second fermentation mode.

In this regard, the refrigerator 1 may receive an input of the control command for the first fermentation mode from the user via the control panel 40 while the second fermentation mode is in progress (2230). That is, the user may input the control command for the first fermentation mode to produce a soft dairy product while the dairy product maker 100 performs fermentation of milk in the second fermentation mode to produce a thick dairy product.

When the fermentation period progressed according to the second fermentation mode is shorter than the fermentation period corresponding to the first fermentation mode (Yes of 2240), the refrigerator 1 according to an embodiment may operate the heater 150 to ferment milk during the fermentation period corresponding to the first fermentation mode (2250).

In addition, when the fermentation period progressed according to the second fermentation mode is longer than the fermentation period corresponding to the first fermentation mode (No of 2240), the refrigerator 1 according to an embodiment may stop the operation of the heater 150, thereby completing fermentation of milk (2260).

That is, upon receiving the control command for the first fermentation mode while the second fermentation mode is in progress, the controller 200 may compare the fermentation period progressed according to the second fermentation mode with the fermentation period corresponding to the first fermentation mode.

When the fermentation period progressed according to the second fermentation mode is shorter than the fermentation period corresponding to the first fermentation mode based on the comparison results, the controller 200 may operate the heater 150 for the fermentation period corresponding to the first fermentation mode.

On the contrary, when the fermentation period progressed according to the second fermentation mode is longer than the fermentation period corresponding to the first fermentation mode based on the comparison results, the controller 200 may turn off the heater 150 to complete fermentation of milk.

As described above, the user may input a control command to convert the fermentation mode while fermentation of milk performed by the dairy product maker 100 is in progress in accordance with the control of the controller 200, and the controller 200 may control the fermentation period of milk according to the fermentation period corresponding to the fermentation mode input by the user and the fermentation period progressed before the control command to convert the fermentation mode is received from the user, thereby completing fermentation of milk.

Figure 23:
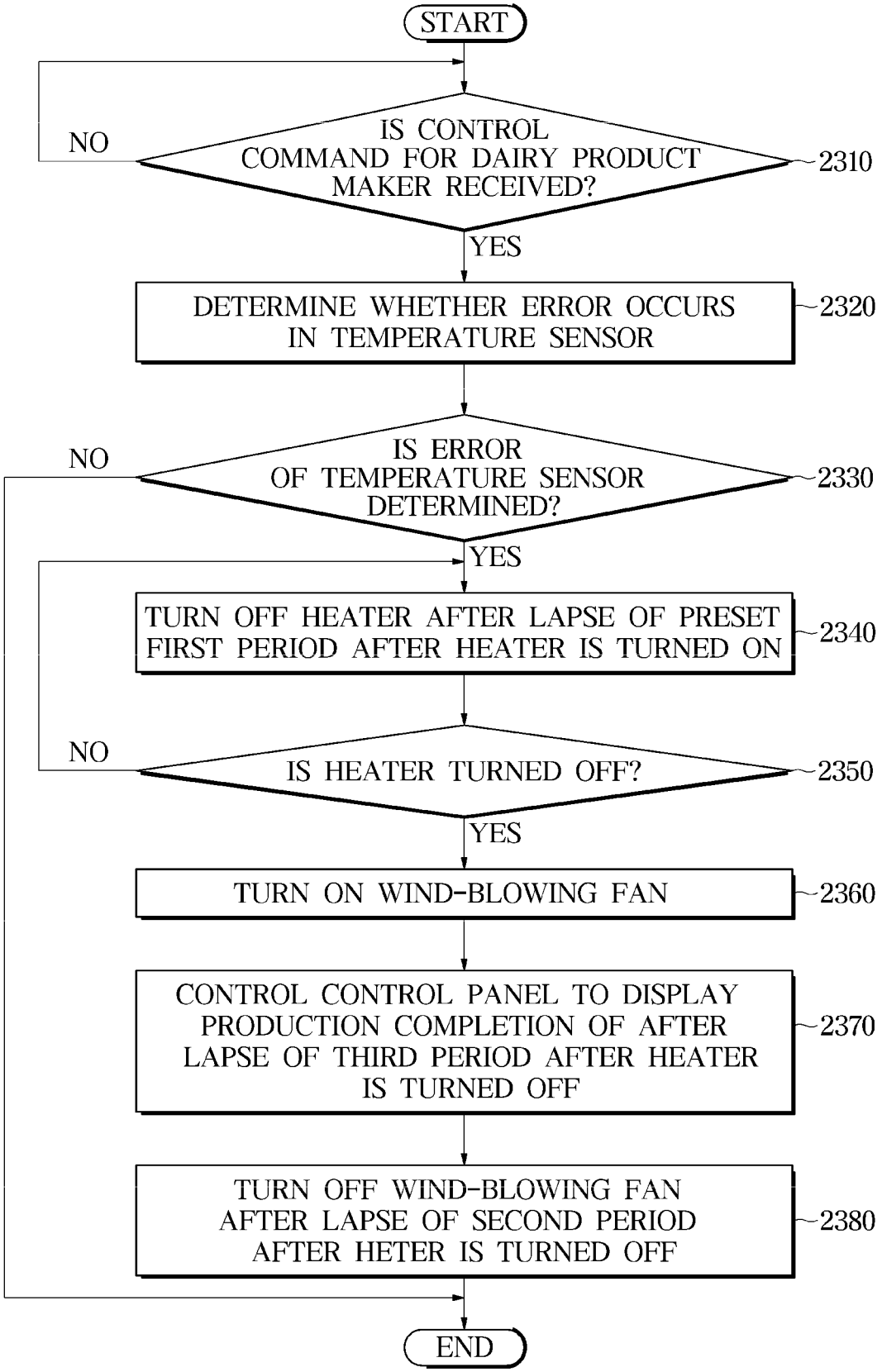
FIG. 23 is a flowchart of a case in which a dairy product is produced when an error occurs in the temperature sensor in a method of controlling a refrigerator according to an embodiment of the present disclosure.

FIG. 23 is a flowchart of a case in which a dairy product is produced when an error occurs in the temperature sensor 161 in the method of controlling the refrigerator 1 according to an embodiment of the present disclosure.

Referring to FIG. 23, upon receiving a control command for the dairy product maker 100 (Yes of 2310), the refrigerator 1 according to an embodiment may determine whether there is an error in the temperature sensor 161 (2320).

Specifically, the controller 200 may determine a case, in which an output from the temperature sensor 161 is 0 V or an input voltage of the temperature sensor 161, as an error of the temperature sensor 161 caused by disconnection or short circuit.

Also, the controller 200 may determine a case, in which the temperature sensor 161 outputs a temperature below a preset first reference temperature for a preset reference period longer, as an error of the temperature sensor 161. For example, when a temperature corresponding to an output voltage of the temperature sensor 161 is below the preset first reference temperature for the preset reference period or longer in an NTC type temperature sensor 161 due to occurrence of high resistance error, the controller 200 may determine this case as an error of the temperature sensor 161.

Also, the controller 200 may determine a case, in which the temperature sensor 161 outputs a temperature above a preset second reference temperature for a preset reference period (e.g.: 3 hours) or longer, as an error of the temperature sensor 161. For example, when a temperature corresponding to an output voltage of the temperature sensor 161 is above a preset second reference temperature for a preset reference period or longer in an NTC type temperature sensor 161 due to occurrence of low resistance error, the controller 200 may determine this case as an error of the temperature sensor 161.

In this regard, the second reference temperature may correspond to a temperature that an internal temperature of the dairy product maker 100 may reach when the heater 150 operates and may be a temperature at which milk may be efficiently fermented (e.g., 37° C.).

Upon determination that there is an error in the temperature sensor 161 (Yes of 2330), the refrigerator 1 according to an embodiment may turn off the heater 150 after the lapse of the preset first period from the time point at which the heater 150 is turned on (2340). When the heater 150 is turned off (Yes of 2350), the wind-blowing fan 160 is turned on (2360).

The preset first period may correspond to the driving period of the heater 150 and may be set differently according to the fermentation mode input by the user. For example, a longer first period may be set for a thicker dairy product based on the fermentation mode.

In this case, even when the controller 200 determines that the operation of the temperature sensor 161 returns to normal because the output temperature of the temperature sensor 161 after the heater 150 is turned on follows the internal temperature of the dairy product maker 100 in the case where the heater 150 is normally turned on, the controller 200 may turn off the heater 150 after a lapse of the preset first period from the time point at which the heater 150 is turned on according to an embodiment.

That is, the controller 200 may turn off the heater 150 after a lapse of the preset first period from the time point at which the heater 150 is turned on although the error of the temperature sensor 161 is resolved after the heater 150 is turned on.

The refrigerator 1 according to an embodiment may control the control panel 40 to display the dairy product production completion 42 after a lapse of the third period after then heater 150 is turned off (2370) and turn off the wind-blowing fan 160 after a lapse of the second period after the heater 150 is turned off (2380).

That is, the controller 200 may determine whether the preset third period elapses in the case where the internal temperature of the dairy product maker 100 drops due to cool air supplied to the dairy product container 141 by the wind-blowing fan 160 after the heater 150 is turned off and may control the control panel 40 to display the dairy product production completion 42 indicating that production of the dairy product is completed in the case where the preset third period elapses from the time point at which the heater 150 is turned off.

The preset third period may be shorter than the preset second period during which the wind-blowing fan 160 operates.

In this regard, the controller 200 according to an embodiment may also control the notifier 50 to output a notification corresponding to the dairy product production completion.

As described above, even when the output of the temperature sensor 161 is inaccurate, the refrigerator 1 may inform the user of production completion of the dairy product by displaying the dairy product production completion 42 after a period of time during which production of the dairy product is expected to be completed from the time point at which the heater 150 is turned off and the wind-blowing fan 160 is turned on.

Therefore, even when an error occurs in the temperature sensor 161, the refrigerator 1 according to an embodiment may provide the user with the function of producing a dairy product by controlling the heater 150 and the wind-blowing fan 160 based on time.

That is, even when the output of the temperature sensor 161 is inaccurate, the refrigerator 1 may provide the user with a dairy product by operating the heater 150 during the first period for fermentation of milk and operating the wind-blowing fan 160 during the second period for cooling the dairy product for refrigerated storage.

Figure 24:
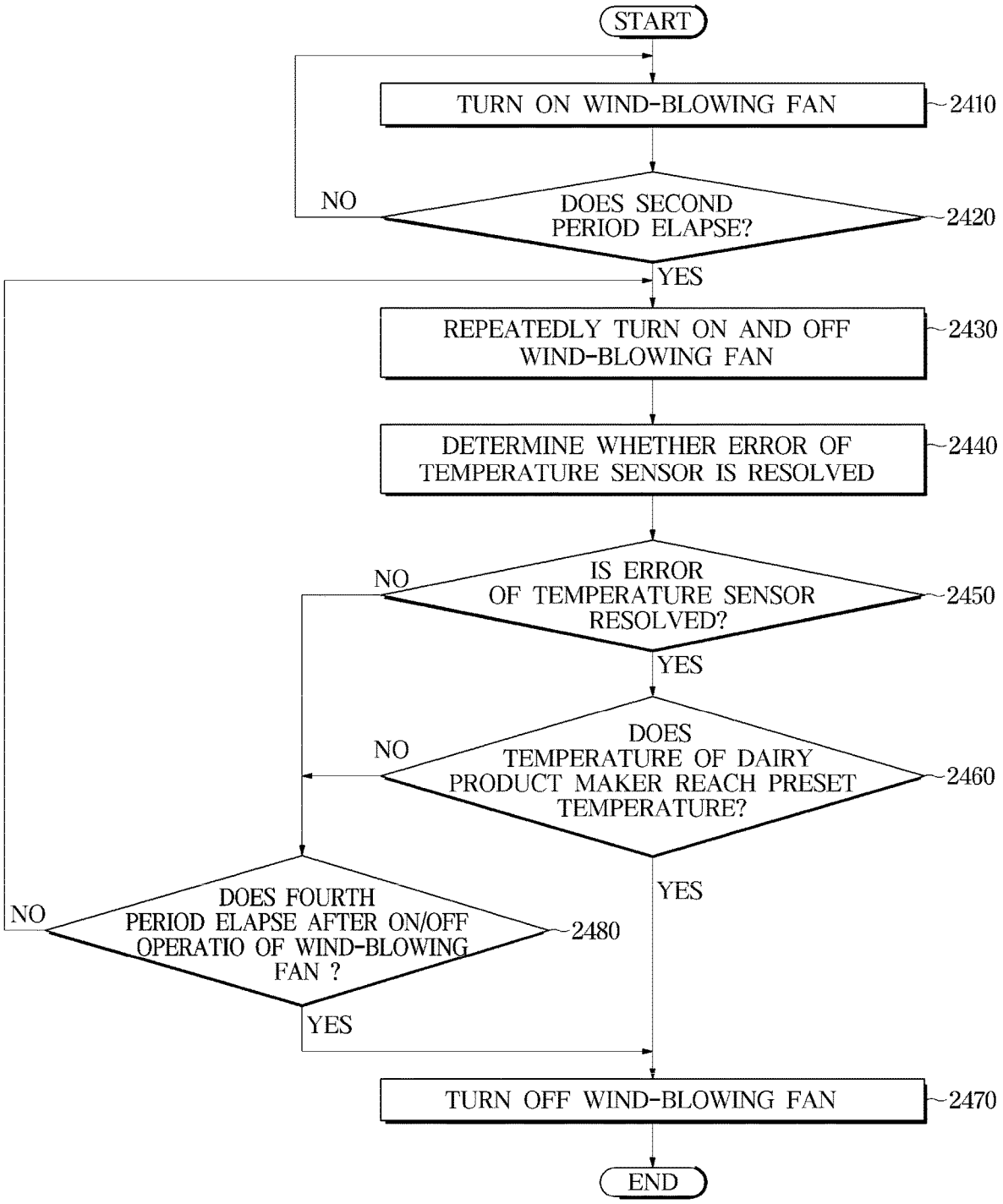
FIG. 24 is a flowchart of a case in which a wind-blowing fan is repeatedly turned on and off in a method of controlling a refrigerator according to an embodiment of the present disclosure.

FIG. 24 is a flowchart of a case in which the wind-blowing fan 160 is repeatedly turned on and off in the method of controlling the refrigerator 1 according to an embodiment of the present disclosure.

Referring to FIG. 24, the refrigerator 1 according to an embodiment may turn on the wind-blowing fan 160 after the heater 150 is turned off (2410) and repeatedly turn on and off the wind-blowing fan 160 (2430) after the second period elapses (Yes of 2420).

The refrigerator 1 according to an embodiment may determine whether the error of the temperature sensor 161 is resolved (2440). In the case where the error of the temperature sensor 161 is not resolved (No of 2450), but the fourth period has elapsed after the on- and off-operations of the wind-blowing fan 160 (Yes of 2480), the refrigerator 1 may turn off the wind-blowing fan 160 (2470).

That is, the controller 200 may continuously supply cool air of the refrigerator compartment 21 to the dairy product container 141 by repeatedly turning on and off the wind-blowing fan 160 for the preset fourth period even after the lapse of the preset second period during which the wind-blowing fan 160 operates. Therefore, the dairy product container 141 may be continuously supplied with cool air from the refrigerator compartment 21 so that the dairy product may be maintained in a refrigeration temperature range for the dairy product. Finally, the refrigerator 1 may provide the user with the dairy product in a ready-to-eat state.

In this case, when the error of the temperature sensor 161 is resolved (Yes of 2450) and the internal temperature of the dairy product maker 100 reaches the preset temperature before the preset fourth period elapses (Yes of 2460), the refrigerator 1 may turn off the wind-blowing fan 160 (2470) according to an embodiment.

Specifically, when the controller 200 determines that the operation of the temperature sensor 161 returns to normal because the output temperature of the temperature sensor 161 when the wind-blowing fan 160 is repeatedly turned on and off follows the internal temperature of the dairy product maker 100 in a state where the wind-blowing fan 160 is normally, repeatedly turned on and off, the controller 200 may determine whether the internal temperature of the dairy product maker 100 reaches the preset temperature. Subsequently, the controller 200 may turn off the wind-blowing fan 160 even before the preset fourth period elapses when the internal temperature of the dairy product maker 100 reaches the preset temperature.

Meanwhile, the aforementioned embodiments may be embodied in the form of a recording medium storing instructions executable by a computer. The instructions may be stored in the form of program codes and perform the operation of the disclosed embodiments by creating a program module when executed by a processor. The recording medium may be embodied as a computer readable recording medium.

The computer readable recording medium includes all types of recording media that store instructions readable by a computer such as read only memory (ROM), random access memory (RAM), magnetic tape, magnetic disc, flash memory, and optical data storage device.

It will be understood by one of ordinary skill in the art that the embodiments of the disclosure are provided for illustration and may be implemented in different ways without departing from the spirit and scope of the disclosure. Therefore, it should be understood that the foregoing embodiments are provided for illustrative purposes only and are not to be construed in any way as limiting the disclosure.

What is claimed is:

1. A refrigerator comprising:

a refrigerator compartment;

a dairy product maker provided inside the refrigerator compartment and to produce a dairy product;

a control panel configured to receive a control command for the dairy product maker and display a state of the dairy product maker; and a controller configured to control the dairy product maker based on the received control command, wherein the dairy product maker comprises:

a container to store milk to produce the dairy product or to store the produced dairy product;

a heater configured to heat the milk stored in the container;

a fan configured to supply cool air inside the refrigerator compartment to the container; and a temperature sensor configured to measure a temperature inside of the dairy product maker, and wherein the controller operates the heater to turn on for a preset fermentation period to produce the dairy product in response to receiving the control command, to turn off the heater and to turn on the fan to cool down the inside of the container to a preset cooling temperature after the preset fermentation period has elapsed, and to control the fan to cool the inside of the container at a preset refrigeration temperature to keep the produced dairy product refrigerated in response to completing of the cooling down inside of the container, and wherein the preset refrigeration temperature is lower than the preset cooling temperature.

2. The refrigerator according to claim 1, wherein the control command includes a control command for a first fermentation mode or a control command for a second fermentation mode, and wherein a fermentation period corresponding to the first fermentation mode is shorter than a fermentation period corresponding to the second fermentation mode.

3. The refrigerator according to claim 2, wherein the controller operates the heater for the fermentation period corresponding to the first fermentation mode in response to receiving the control command for the first fermentation mode, and extends an operation period of the heater to operate the heater for the fermentation period corresponding to the second fermentation mode in response to receiving the control command for the second fermentation mode while the first fermentation mode is in progress.

4. The refrigerator according to claim 2, wherein the controller operates the heater for the fermentation period corresponding to the second fermentation mode in response to receiving the control command for the second fermentation mode, and compares a fermentation period progressed according to the second fermentation mode with the fermentation period corresponding to the first fermentation mode in response to receiving the control command for the first fermentation mode while the second fermentation mode is in progress.

5. The refrigerator according to claim 4, wherein the controller operates the heater during the fermentation period corresponding to the first fermentation mode in response to the fermentation period progressed according to the second fermentation mode being shorter than the fermentation period corresponding to the first fermentation mode, and the controller turns off the heater in response to the fermentation period progressed according to the second fermentation mode being longer than the fermentation period corresponding to the first fermentation mode.

6. The refrigerator according to claim 2, wherein the controller turns off the heater and turns on the fan in response to receiving a control command for a cooling mode while the heater operates, and turns off the fan and turns on the heater in response to receiving a control command for the first fermentation mode or a control command for the second fermentation mode while the fan operates.

7. The refrigerator according to claim 1, wherein the controller counts a progression of the preset fermentation period in response to the temperature of the dairy product maker being higher than a preset fermentation start temperature, and turns on the heater to increase the temperature of the dairy product maker to the preset fermentation start temperature in response to the temperature of the dairy product maker being below the preset fermentation start temperature, and counts the progression of the preset fermentation period from a time point at which the temperature of the dairy product maker reaches the fermentation start temperature.

8. The refrigerator according to claim 1, wherein the controller determines whether an error occurs in the temperature sensor while operating during the preset fermentation period in response to receiving the control command for the dairy product maker, and in response to determining that there is an error in the temperature sensor, the controller turns off the heater after the heater is turned on for a preset first period from a time point at which the heater is turned on, and operates the fan for a preset second period to produce the dairy product after the heater is turned off.

9. The refrigerator according to claim 8, wherein the controller controls the control panel to display an error state in response to determining that an error occurs in one or more of the heater, the fan, and the temperature sensor.

10. The refrigerator according to claim 8, wherein the controller controls the control panel to display a production completion state after a preset third period has elapsed after the heater is turned off.

11. The refrigerator of claim 10, wherein the preset third period is shorter than the preset second period.

12. The refrigerator according to claim 8, wherein the controller determines an error of the temperature sensor in response to the controller receiving an output of the temperature sensor is 0V or an input voltage of the temperature sensor is 0V.

13. The refrigerator according to claim 8, wherein the controller determines an error of the temperature sensor in response to the temperature sensor outputting a temperature lower than or equal to a preset first reference temperature for a preset reference period or longer.

14. The refrigerator according to claim 8, wherein the controller determines an error of the temperature sensor in response to the temperature sensor outputting a temperature above a preset second reference temperature for a preset reference period or longer.

* * * * *